US008129084B2

(12) United States Patent
Inaba et al.

(10) Patent No.: US 8,129,084 B2
(45) Date of Patent: Mar. 6, 2012

(54) LIQUID DEVELOPER, METHOD FOR PRODUCING LIQUID DEVELOPER, AND IMAGE FORMING APPARATUS

(75) Inventors: Yoshihiro Inaba, Kanagawa (JP); Takako Kobayashi, Kanagawa (JP); Ryosaku Igarashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 343 days.

(21) Appl. No.: 12/545,513

(22) Filed: Aug. 21, 2009

(65) Prior Publication Data

US 2010/0248127 A1 Sep. 30, 2010

(30) Foreign Application Priority Data

Mar. 24, 2009 (JP) ..... 2009-072250

(51) Int. Cl.
*G03G 9/00* (2006.01)

(52) U.S. Cl. ..... 430/114; 430/115; 430/137.22; 399/237

(58) Field of Classification Search ..... 430/114, 430/115, 137.22; 399/237
See application file for complete search history.

(56) References Cited

U.S. PATENT DOCUMENTS

| | | | |
|---|---|---|---|
| 2003/0175518 | A1 | 9/2003 | Ishitani et al. |
| 2005/0008960 | A1 | 1/2005 | Yaguchi et al. |
| 2005/0069800 | A1 | 3/2005 | Coppenrath et al. |

FOREIGN PATENT DOCUMENTS

| | | |
|---|---|---|
| JP | A-60-073548 | 4/1985 |
| JP | A-60-073549 | 4/1985 |
| JP | A-63-050856 | 3/1988 |
| JP | A-05-188827 | 7/1993 |
| JP | A-07-064333 | 3/1995 |
| JP | A-08-045716 | 2/1996 |
| JP | A-10-247037 | 9/1998 |
| JP | A-2003-202704 | 7/2003 |
| JP | A-2005-031275 | 2/2005 |
| JP | A-2005-107528 | 4/2005 |
| JP | A-2007-093669 | 4/2007 |

*Primary Examiner* — Mark Chapman
(74) *Attorney, Agent, or Firm* — Oliff & Berridge, PLC

(57) ABSTRACT

A liquid developer includes: magnetic polymer particles including a magnetic material containing yttrium iron garnet (YIG), a polymer compound having a carboxylate salt structure, and a colorant; and a dispersion medium in which the magnetic polymer particles are dispersed.

20 Claims, 2 Drawing Sheets

LIQUID DEVELOPER, METHOD FOR PRODUCING LIQUID DEVELOPER, AND IMAGE FORMING APPARATUS

CROSS-REFERENCE TO RELATED APPLICATIONS

This application is based on and claims priority under 35 USC 119 from Japanese Patent Application No. 2009-072250 filed Mar. 24, 2009.

BACKGROUND

1. Technical Field

The present invention relates to a liquid developer, a method for producing a liquid developer, and an image forming apparatus.

2. Related Art

As an image forming method that makes use of a magnetic material, there has been known so-called magnetography in which a magnetic head is operated to form a magnetic latent image on a magnetic recording medium having a magnetic material on a surface thereof, and the magnetic latent image, after developed with a magnetic toner, is transferred by heating or electrostatically to a transfer medium, and fixed to carry out printing. A technology in which a magnetic toner is used in this technology has been reported.

When a color image is formed by magnetography in which a magnetic toner is used to develop the magnetic latent image, a colored magnetic material such as magnetite is contained in a magnetic toner.

SUMMARY

According to an aspect of the invention, there is provided a liquid developer including magnetic polymer particles including a magnetic material containing yttrium iron garnet (YIG), a polymer compound having a carboxylate salt structure, and a colorant; and a dispersion medium in which the magnetic polymer particles are dispersed.

BRIEF DESCRIPTION OF THE DRAWINGS

Exemplary embodiments of the present invention will be described in detail based on the following figures, wherein.

DETAILED DESCRIPTION

Figure 1:
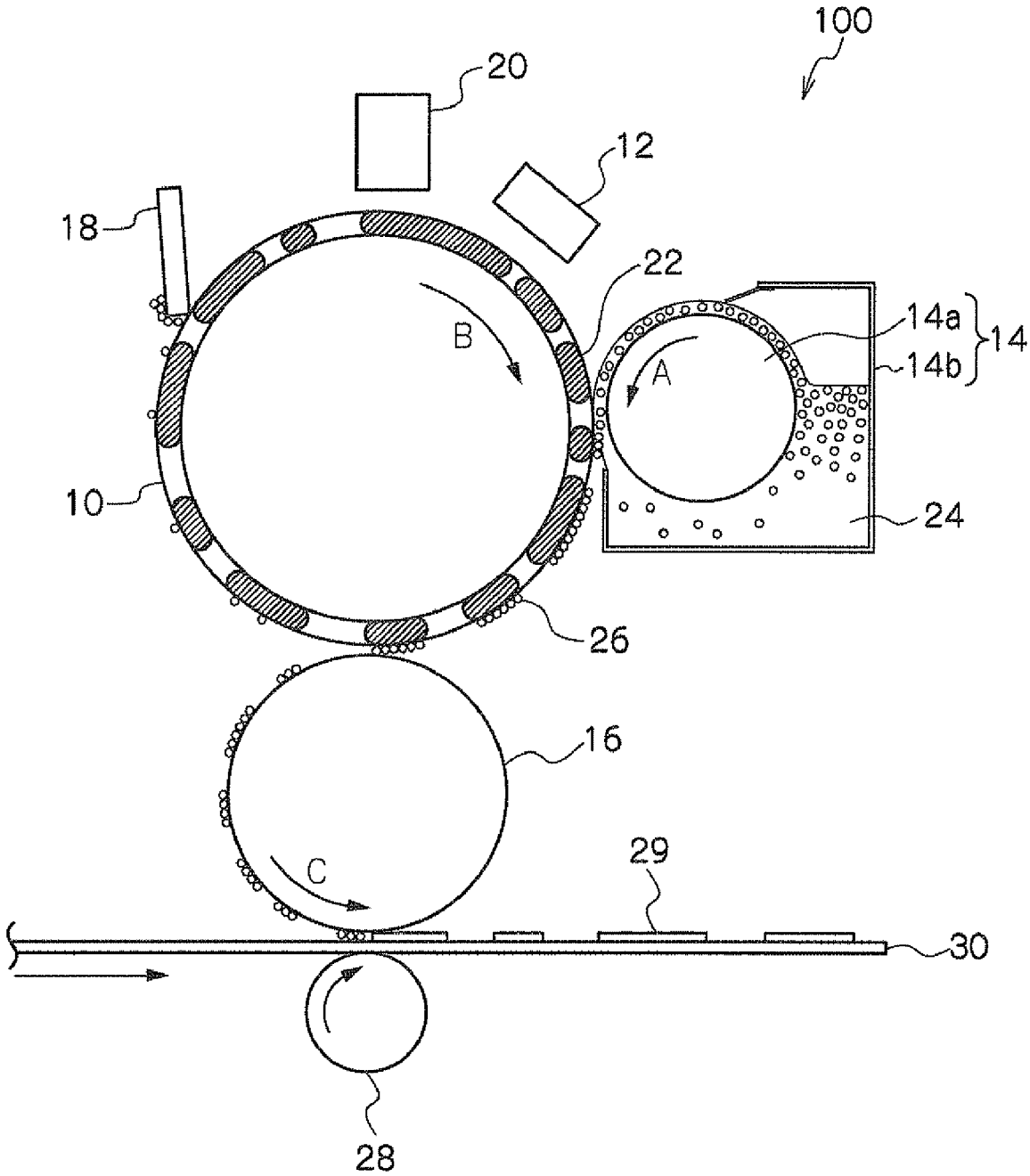
FIG. 1 is a schematic configurational view showing one example of an image forming apparatus according to the exemplary embodiment.

In what follows, an exemplary embodiment of the present invention will be detailed.

<Liquid Developer>

A liquid developer according to the exemplary embodiment (hereinafter, simply referred to as "developer" in some cases) includes magnetic polymer particles containing a magnetic material containing yttrium iron garnet (YIG), a polymer compound having a carboxylate salt structure and a colorant, and a dispersion medium for dispersing the magnetic polymer particles.

A developer according to the exemplary embodiment, which is configured as shown above, may inhibit fog (a phenomenon in which a developer attaches to a non-image portion to form a color in a portion that is not an image) from occurring. The reason for this is not necessarily clear but may be considered as described below.

In a conventional magnetic toner (magnetic polymer particles), a large amount of magnetic material is added to maintain a magnetic force of the particles; accordingly, a color other than black is difficult to form, that is, colorization of the toner is difficult. In contrast, when a magnetic material containing YIG is used, an adverse affect on a color reproduction area of an image formed with magnetic polymer particles is suppressed, thereby resulting in a wide color reproduction area. However, even when a magnetic material containing YIG is used, there is a problem of fog in a formed image.

In contrast, it is considered that magnetic polymer particles contained in a liquid developer according to the exemplary embodiment contains a polymer compound (binder component) having a carboxylate salt structure; accordingly, adhesiveness of the magnetic polymer particle decreases, and the hydrophilicity is improved to result in inhibiting fog in an image from occurring.

Volume Average Particle Diameter

A volume average particle diameter of magnetic polymer particles in the exemplary embodiment may be 1 μm or more but 3 μm or less (about 1 μm or more but about 3 μm or less).

In the developer according to the exemplary embodiment, when the volume average particle diameter of the magnetic polymer particles is in the above range, the color reproduction area is expanded. The reason for this is not necessary clear but may be considered as follows.

When a magnetic material containing YIG is used, a color reproduction area is expanded as mentioned above. When a particle diameter is smaller, a distance from a magnetic latent image becomes smaller to increase a magnetic force applied from a magnetic latent image. As the result, it is considered that an image may be formed even with particles containing less magnetic material, and thereby the color reproduction area is enlarged. Furthermore, since the particle diameter is smaller, a concentration of pigment is made higher for the purpose of obtaining adequate density with relatively small amount of a developer. As the result, an amount of pigment becomes relatively larger to a magnetic material, and thereby a color reproduction area is considered to be expanded. It is also considered that when a particle diameter is smaller, a high quality image is achieved.

However, when a particle diameter of magnetic polymer particles is smaller, there is a problem in that the fog becomes conspicuous. However, in the magnetic polymer particles in the exemplary embodiment, a polymer compound (binder component) having a carboxylate salt structure is contained as mentioned above; accordingly, the fog in an image is inhibited from occurring. Accordingly, when a developer according to the exemplary embodiment contains magnetic polymer particles having a particle diameter in the above range, the fog is effectively inhibited from occurring, and a color reproduction area is more expanded.

When a volume average particle diameter of the magnetic polymer particles is 3 μm or less, a color reproducing area is expanded. On the other hand, when the volume average particle diameter thereof is 1 μm or more, a transfer property and a developing property are secured without rendering adhesive force excessively strong.

A measurement method of the volume average particle diameter, a more specific range thereof and a control method thereof will be described later.

Content of Magnetic Material

When a volume average particle diameter of magnetic polymer particles in the exemplary embodiment is within the above range, content of a magnetic material in the magnetic polymer particles may be 1% by weight or more but 6% by weight or less (about 1% by weight or more but about 6% by weight or less).

In a developer according to the exemplary embodiment, when the above volume average particle diameter and the above content are satisfied, a color reproduction area is expanded. The reason for this is not necessarily clear but may be considered as shown below.

That is, it is considered that, when magnetic polymer particles have a smaller particle diameter and the magnetic material is blended in the above amount, an adequate magnetic force is obtained and an amount of magnetic material per unit area on an image becomes smaller, and thereby an adverse affect on a color reproduction area is suppressed to result in a wider color reproduction area.

When the magnetic material is contained in an amount of 6% by weight or less, a color reproduction area is expanded. On the other hand, when the content thereof is 1% by weight or more, the magnetic force imparted to the magnetic polymer particles is inhibited from decreasing to result in inhibiting the developing property from deteriorating.

A more specific range will be described later.

In what follows, a configuration of a developer according to the exemplary embodiment will be specifically described.

(Magnetic Polymer Particles)

Magnetic polymer particles in the exemplary embodiment contain a magnetic material containing at least YIG a polymer compound having a carboxylate salt structure, and a colorant. To the magnetic polymer particles, external additive particles may be externally added (that is, external additive particles are attached to magnetic polymer particles).

-Magnetic Material-

The magnetic material contains yttrium iron garnet (YIG) (hereinafter, referred to as "YIG particles").

A number average particle diameter of YIG particles may be 0.2 μm or more but 1.8 μm or less (about 0.2 μm or more but about 1.8 μm or less), 0.3 μm or more but 1.5 μm or less, or 0.3 μm or more but 1.1 μm or less.

The number average particle diameter is obtained in such a manner that dry YIG particles are photographed with a scanning electron microscope (SEM), particle diameters of 100 particles selected at random therefrom are measured respectively, and a sum total thereof is divided by the number of particles.

The magnetization of the YIG particles in a magnetic field of 500 Oe may be 10 emu/g or more (about 10 emu/g or more), 15 emu/g or more, or 20 emu/g or more.

Herein, magnetic characteristics are measured by use of a sample vibration-type magnetic measurement apparatus (trade name: VSMP10-15, manufactured by Toei Industry Co., Ltd.). A measurement sample is charged in a cell having an internal diameter of 7 mm and a height of 5 mm, and set in the apparatus. Upon measurement, a magnetic field is applied and swept up to 500 Oe (oersted) at the maximum. Then, an applied magnetic field is decreased, and thereby a hysteresis curve is obtained. From the hysteresis curve, magnetization at 500 Oe is obtained.

A surface of a YIG particle may be hydrophobicized. A hydrophobicizing process is not particularly restricted and may be conducted by covering a surface of a magnetic material with a hydrophobicizing agent such as various coupling agents, silicone oils or resins. Among these, a coupling agent may be used to apply surface coating.

A surface of a YIG particle is fundamentally hydrophilic. When the YIG particle is hydrophobicized, affinity to a hydrophobic monomer of a polymer compound is improved. As the compatibility with a hydrophilic monomer and a hydrophobic monomer in a polymer compound is improved, the dispersion property of the magnetic material in the magnetic polymer particle is heightened.

Content of a magnetic material containing YIG particles in the magnetic polymer particles may be, in the case where a volume average particle diameter of the magnetic polymer particles is 1 μm or more but 3 μm or less (about 1 μm or more but about 3 μm or less) as mentioned above, 1% by weight or more but 6% by weight or less (about 1% by weight or more but about 6% by weight or less), 1% by weight or more but 5% by weight or less, or 1% by weight or more but 4.5% by weight or less.

In the next place, a method for producing YIG particles will be described. As a method for producing YIG particles, a method for producing particles according to a bottom-up method such as a coprecipitation method or a method for producing particles according to a top-down method such as a milling method is exemplified.

However, when YIG particles are produced, for example, following processes may be adopted.

1) In any of a bottom-up process and a top-down process, an annealing process is applied as a post-treatment. A treatment temperature of the annealing process may be, for example, 700° C. or more but 1500° C. or less, or 800° C. or more but 1200° C. or less.

2) In the case of a top-down process, a wet process is applied. Examples of a liquid used in a wet process include water, alcohol (for example, isopropyl alcohol or ethanol), acetone, or hexane. A usage amount of the liquid is 1 g or more with respect to 2 g of particles.

A coprecipitation process, which is a bottom-up process, is a process that makes use of a coprecipitation phenomenon, in which a substance that does not precipitate itself is allowed to coexist with a substance that precipitates to coprecipitate them. Specifically, a coprecipitate is generated by mixing a mixed solution of an aqueous solution of yttrium metal salt and an aqueous solution of a ferric salt with an alkaline aqueous solution.

As an alkaline aqueous solution, for example, an aqueous solution of NaOH may be exemplified. As the alkaline aqueous solution, an aqueous solution of, for example, $NH_4OH$, $(NH4)_2CO_3$, $Na_2CO_3$ or $NaHCO_3$ is exemplified as well. An alkali concentration of an alkaline aqueous solution may be set by considering pH during a coprecipitation reaction.

Examples of yttrium metal salt include, for example, a halide [chloride ($YCl_3$) or bromide ($YBr_3$)] or a nitrate [$Y(NO_3)_3$].

Examples of ferric salt include, for example, a halide [chloride ($FeCl_3$) or bromide ($FeBr_3$)], a sulfate [$Fe_2(SO_3)_3$] or a nitrate [$Fe(NO_3)_3$].

When YIG particles are prepared in such a manner that, while dropping an aqueous solution of yttrium metal salt and an aqueous solution of the ferric salt in an alkaline aqueous solution, a coprecipitation reaction is forwarded to generate precipitate to prepare YIG particles, in order to obtain an average primary particle diameter of obtained YIG particles in the range of 1 nm or more but 500 nm or less, in the coprecipitation reaction, dropping speeds of both aqueous solutions of metal salt to an alkaline aqueous solution may be 10 ml/min or more but 100 ml/min or less, or 20 ml/min or more but 60 ml/min or less.

A stirring time during and after dropping a liquid may be 10 min or more but 60 min or less, or 30 min or more but 60 min or less.

A final pH value of a reaction aqueous solution during a coprecipitation reaction may be 12 or more, or 12.5 or more but 13.8 or less, or 13 or more but 13.5 or less.

When a precipitate is dried, it may be heated at 50° C. or more but 200° C. or less, or at 100° C. or more but 200° C. or less.

On the other hand, a milling process, which is a top-down process, is conducted with various pulverizer. Examples of pulverizer being adopted include, for example a jet mill, a vibration mill, a ball mill, a planetary ball mill, a beads mill, or a disc mill. Among these, a beads mill, in particular, a wet beads mill may be used.

YIG particles used as a raw material being pulverized may be YIG particles obtained by the coprecipitation method or commercially available YIG particles. Examples of commercially available YIG particles include, for example, Yttrium Iron Oxide, NANOPOWDER (trade name, manufactured by Aldrich Inc.) or yttrium iron garnet $Y_3Fe_5O_{12}$ (manufactured by Kojundo Kagaku Co., Ltd.).

-Polymer Compound-

A polymer compound contained in a magnetic polymer particles in the exemplary embodiment has a carboxylate salt structure. As a method for introducing a carboxylate salt structure into the polymer compound, a method in which after magnetic polymer particles are prepared, a neutralization process is applied to the magnetic polymer particles may be exemplified. Details thereof will be described later.

As a polymer compound used for producing magnetic polymer particles in the exemplary embodiment, a resin that has been conventionally used in magnetic polymer particles may be used. Specific examples thereof include homopolymers of styrene and a substitution product thereof and copolymer resins thereof, a copolymer resin of styrene and (meth) acrylic ester, a multi-copolymer resin of styrene, (meth) acrylic ester and other vinyl monomer, a styrene copolymer resin of styrene and other vinyl monomer and those obtained by partially crosslinking the respective resins. Example thereof further include a simple substance such as polymethyl methacrylate, polybutyl methacrylate, a polyvinyl acetate resin, a polyester resin, an epoxy resin, a polyamide resin, a polyolefin resin, a silicone resin, a polybutyral resin, a polyvinyl alcohol resin, a polyacrylic acid resin, a phenol resin, an aliphatic or alicyclic hydrocarbon resin, a petroleum resin, a styrene-vinyl acetate copolymer resin, an ethylene-vinyl acetate copolymer resin or a wax resin; and mixtures thereof.

As a polymer compound, a thermoplastic resin may be exemplified.

Among the foregoing polymer compounds, as a thermoplastic resin, a polymer obtained by polymerizing at least one of, for example, a (meth)acrylate monomer and a styrene monomer is specifically exemplified.

In the (meth)acrylate monomer, the alcohol residue of the (meth)acrylic acid ester may be a substituted or unsubstituted alkyl group having 1 or more but 18 or less carbon atoms. Examples of the alkyl group include, for example, a methyl group, an ethyl group, an n-propyl group, an isopropyl group, an n-butyl group, a t-butyl group, a pentyl group, an isopentyl group, a neopentyl group, a hexyl group, a heptyl group, an n-octyl group, a nonyl group, a decyl group, an undecyl group, or a dodecyl group. The alcohol residue may be, other than the alkyl group, a benzyl group, a hydroxyethyl group, a hydroxyethyl group in which a hydroxy group is protected with a hydrophobic protective group such as dihydropyrane, or a polyoxyethylene group.

As the polymer compound, a polymer containing hydroxyethyl methacrylate or the (meth)acrylate polymer further modified with (poly)ethylene glycol may be used.

As the styrene monomer, a vinyl group-containing monomer having a substituted or unsubstituted aryl group having 6 or more but 12 or less carbon atoms may be exemplified. Examples of the aryl group include, for example, a phenyl group, a naphthyl group, a tolyl group, or a p-n-octyloxyphenyl group. Among these, a phenyl group may be exemplified.

Examples of a substituent in an alkyl group of the (meth) acrylate monomer and in an aryl group of the styrene monomer include an alkyl group, an alkoxy group, a halogen atom or an aryl group.

As the alkyl group, those exemplified as the above alkyl group are similarly exemplified. Examples of the alkoxy group include, for example, a methoxy group, an ethoxy group, a propoxy group or a butoxy group. Among these, a methoxy group or an ethoxy group may be exemplified. Furthermore, examples of the halogen atom include a fluorine atom, a chlorine atom, a bromine atom or an iodine atom. Among these, a fluorine atom or a chlorine atom may be exemplified. As the aryl group, those exemplified as the above aryl group are similarly exemplified.

When both of a (meth)acrylate monomer and a styrene monomer are used as monomer, a ratio of contents between a (meth)acrylate monomer and a styrene monomer in a mixture may be, by a mol ratio (a (meth)acrylate monomer/a styrene monomer), in the range of 95/5 to 5/95, or in the range of 90/10 to 10/90.

A polymer compound used to produce magnetic polymer particles in the exemplary embodiment may have a carboxyl group. Furthermore, the polymer compound may have at least one selected from a hydroxy group and an alkyl ester group thereof. When the above functional group is introduced into a polymer compound, a monomer constituting the polymer compound is selected.

Examples of a monomer having a carboxyl group include, for example, acrylic acid, methacrylic acid, methacryloyloxyethyl monophthalate, methacryloyloxyethyl monohexahydrophthalate, methacryloyloxyethyl monomaleate or methacryloyloxyethyl monosuccinate.

Examples of a monomer having a hydroxy group include, for example, 2-hydroxyethyl (meth)acrylate, 2-hydroxypropyl (meth)acrylate, 3-hydroxypropyl (meth)acrylate, glycerin di(meth)acrylate, 1,6-bis(3-acryloxy-2-hydroxypropyl)-hexyl ether, pentaerythritol tri(meth)acrylate, tris-(2-hydroxyethyl)isocyanuric acid ester (meth)acrylate or polyethylene glycol (meth)acrylate.

Herein, the (meth)acrylate means acrylate or (meth)acrylate.

Existence of the respective functional groups may be confirmed by measuring an infrared absorption spectrum of the magnetic polymer particles. However, the measurement is affected by a magnetic material; accordingly, a method shown below may be conducted.

That is, a hydroxyl group or a carboxyl group in the magnetic polymer particles is different depending on the magnetic material; accordingly, a hydroxyl group or a carboxyl group of a polymer compound may be confirmed by determining an amount of hydroxyl groups or an amount of carboxyl groups of a polymer component from which a magnetic material is removed.

When a polymer compound has carboxyl groups, an amount of carboxyl groups may be in the range of 0.005 mmol/g or more but 0.5 mmol/g or less (about 0.005 mmol/g or more but about 0.5 mmol/g or less), in the range of 0.008 mmol/g or more but 0.3 mmol/g or less, or in the range of 0.01 mmol/g or more but 0.1 mmol/g or less.

When the polymer compound further has hydroxyl groups, an amount of hydroxyl groups may be in the range of 0.2 mmol/g or more but 4.0 mmol/g or less (about 0.2 mmol/g or more but about 4.0 mmol/g or less), or in the range of 0.3 mmol/g or more but 3.0 mmol/g or less.

The amount of hydroxyl groups may be obtained by a general titration method. For example, a reagent such as a pyridine solution of acetic anhydride is added to the polymer compound, followed by heating, further followed by adding water to hydrolyze, followed by separating particles and a supernatant by use of a centrifugal classifier, further followed by titrating the supernatant with an ethanolic potassium hydroxide solution with an indicator such as phenolphthalein, thereby an amount of hydroxyl groups is obtained.

On the other hand, an amount of carboxyl groups may also be obtained by a general titration method. For example, the polymer compound is dispersed in N,N'-dimethylformamide, followed by titrating with an ethanolic potassium hydroxide solution with an indicator such as phenolphthalein, thereby an amount of carboxyl groups is obtained.

When a carboxyl group forms a salt structure described below ($—COO^-Y^+$: herein, $Y^+$ represents an alkali metal ion, an alkaline earth metal ion or an organic cation such as ammonium), a salt is converted to carboxylic acid with an acid such as hydrochloric acid and the titration is conducted to obtain an amount of carboxyl groups.

That is, herein, an amount of carboxyl groups means, when a carboxyl group forms a salt structure, an amount of carboxyl groups including carboxyl groups contributing to the salt structure.

A polymer compound may be further copolymerized with a crosslinkable monomer (crosslinking agent). Specific examples of a crosslinking agent include divinyl benzene, ethylene glycol di(meth)acrylate, diethylene glycol di(meth) acrylate, glycidyl (meth)acrylate, and 2-([1'-methylpropylideneamino]carboxyamino)ethyl(meth)acrylate. These may be used to form a crosslinking structure during polymerization or may be crosslinked after polymer particles are formed by polymerization.

Content of a crosslinking agent in a monomer mixture may be, relative to 100 parts by weight of a total amount of (meth) acrylate monomer and/or styrene monomer, in the range of 0.05 parts by weight or more but 20 parts by weight or less, or in the range of 0.5 parts by weight or more but 10 parts by weight or less.

The polymer compound may contain a non-crosslinked resin. The non-crosslinked resin is not particularly restricted as long as it is a polymer that allows particles to be fixed on a fixing medium such as paper or film by external energy such as heat, ultraviolet rays or electron beams, or solvent vapor, or volatilization of a solvent from a polymer.

Specific examples of non-crosslinked resin include homopolymers and copolymers of for example, styrenes such as styrene or chlorostyrene; monoolefins such as ethylene, propylene, butylene or isoprene; vinyl esters such as vinyl acetate, vinyl propionate, vinyl benzoate or vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate or dodecyl methacrylate; vinyl ethers such as vinyl methyl ether, vinyl ethyl ether or vinyl butyl ether; and vinyl ketones such as vinyl methyl ketone, vinyl hexyl ketone or vinyl isopropenyl ketone.

When a polymer compound contains a non-crosslinked polymer, a molecular weight (number average molecular weight) of the non-crosslinked polymer may be in the range of 5000 or more but 1000000 or less, or in the range of 10000 or more but 500000 or less.

The number average molecular weight is measured in such a manner that a polymer compound is dissolved in THF and a component separated as a soluble component is measured by gel permeation chromatography (GPC).

-Colorant-

The magnetic polymer particles may further contain a colorant such as a pigment, carbon black or a dye for the purpose of coloring the polymer compound. In that case, in the course of producing magnetic polymer particles, the respective additives may be added to a mixture such as a monomer in which a magnetic material is dispersed, or, after the additives, a magnetic material and the monomer are mixed in advance, the magnetic material may be dispersed simultaneously with dispersion of the respective additives.

Color that Developer Forms and Content of Colorant

A developer according to the exemplary embodiment may be used as a developer that forms a yellow, magenta, red or green colon A magnetic material containing YIG is itself a yellow to green-colored magnetic material and effective for obtaining a colored developer. In particular, an absorption spectrum characteristic thereof has an absorption in a wavelength region of 500 nm or less, and a small absorption in a region of a longer wavelength than that. Thus, when the above color is adopted as a color of a developer (color of magnetic polymer particles), a color reproduction area of the color is expanded.

When a color of a developer is yellow, content of a colorant in the magnetic polymer particles may be 8% by weight or more but 40% by weight or less (about 8% by weight or more but about 40% by weight or less), or 8% by weight or more but 35% by weight or less.

When a color of a developer is magenta, content of a colorant in the magnetic polymer particles may be 14% by weight or more but 40% by weight or less (about 14% by weight or more but about 40% by weight or less), or 14% by weight or more but 35% by weight or less.

When a color of a developer is red, content of a colorant in the magnetic polymer particles may be 11% by weight or more but 40% by weight or less (about 11% by weight or more but about 40% by weight or less), or 11% by weight or more but 35% by weight or less.

When a color of a developer is green, content of a colorant in the magnetic polymer particles may be 9% by weight or more but 40% by weight or less (about 9% by weight or more but about 40% by weight or less), or 9% by weight or more but 35% by weight or less.

Examples of the colorant include, for example, an inorganic pigment such as colcothar, iron blue, titanium oxide or chromium oxide; an azo pigment such as Fast Yellow, Disazo Yellow, Pyrazolone Red, Chelate Red, Brilliant Carmine, Para Brown or Nitroso Green; a phthalocyanine pigment such as copper phthalocyanine, nonmetal phthalocyanine or phthalocyanine green; and a condensed polycyclic pigment such as Flavanthrone Yellow, Dibromoanthrone Orange, Perylene Red, Quinacridone Red or Dioxazine Violet.

In magnetic polymer particles of the exemplary embodiment, in order to be suitably used for color display as shown above, pigments for coloring in magenta, yellow, cyan, red, and green may be used.

More specifically, examples thereof include various pigments such as Chrome Yellow, Hansa Yellow, Benzidine Yellow, Indanthrene Yellow, Quinoline Yellow, Permanent Yellow FGL, Permanent Orange GTR, Pyrazolone Orange, Vulcan Orange, Watchung Red, Permanent Red, DuPont Oil Red, Lithol Red, Rhodamine B Lake, Lake Red C, Rose Bengal, Aniline Blue, Ultramarine Blue, Carco Oil Blue, Methylene Blue Chloride, Phthalocyanine Blue, PV Fast Blue, Phthalocyanine Green, Malachite Green Oxalate, Chrome Green, Viridian, Emerald Green, Heliogen Green, Pigment Green B, Malachite Green Lake, FanalGreen, Fanal Yellow Green, C.I. Pigment Yellow 1, 2, 3, 12, 13, 14, 16, 17, 73, 74, 75, 83, 93, 95, 97, 98, 114, 120, 128, 129, 151, 154, 175, 180, 181, 194, C.I. Pigment Red 5, 7, 9, 11, 12, 48, 48:1, 57, 81, 97, 112, 122, 123, 146, 149, 168, 177, 180, 184, 192, 202, 209, 213, 215, 216, 217, 220, 223, 224, 226, 227, 228, 238, 240, 254, 255, 264, 270, 272, C.I. Pigment Green 7, 36, 8, and C.I. Pigment Blue 15, 15:1, 15:2, 15:3, 15:4, 15:6, or 16. These may be used singularly or in a combination of at least two thereof.

A volume average particle diameter of a colorant is measured by use of a laser diffraction particle size distribution analyzer (trade name: LA-700, manufactured by Horiba Ltd.).

-Other Components-

In the magnetic polymer particles of the exemplary embodiment, in accordance with the object, components such as a mold releasing agent, inorganic particles, a lubricant or a polishing agent may be contained Examples of the mold releasing agent used here include for example: low molecular weight polyolefins such as polyethylene, polypropylene or polybutene; silicones having a softening point by heating; aliphatic acid amides such as oleic acid amide, erucic acid amide, ricinoleic acid amide or stearic acid amide; long chain aliphatic alcohols such as lauryl alcohol, stearyl alcohol, or behenyl alcohol; a vegetable wax such as carnauba wax, rice wax, candelilla wax, Japan wax or jojoba oil; an animal wax such as bees wax; a mineral or petroleum wax such as montan wax, ozokerite, ceresin, paraffin wax, microcrystalline wax or Fischer-Tropsch wax; or modified products thereof -Method for Producing Magnetic Polymer Particles- A known method is used to obtain magnetic polymer particles. Examples thereof include a kneading-pulverizing method, a suspension polymerization method, an emulsion aggregation method, a dispersion polymerization method or a seed polymerization method. Furthermore, an emulsifying method known as a film emulsifying method may be used to conduct a suspension polymerization.

Suspension Polymerization Method

Specifically, when magnetic polymer particles are prepared according to, for example, the suspension polymerization method, firstly, a mixture of a certain amount of a monomer that constitutes the polymer compound, a magnetic material, a colorant, a crosslinking agent and a polymerization initiator is prepared.

As a crosslinking agent, a known crosslinking agent may be used. Examples thereof include, for example, divinyl benzene, ethylene glycol di(meth)acrylate, diethylene glycol di(meth)acrylate, methylene bis(meth)acrylamide, glycidyl (meth)acrylate, or 2-([1'-methylpropylideneamino]carboxyamino)ethyl (meth)acrylate. Among these, divinyl benzene, ethylene glycol di(meth)acrylate, or diethylene glycol di(meth)acrylate may be exemplified, and divinyl benzene may be exemplified. As a polymerization initiator, an azo polymerization initiator or a peroxide initiator may be exemplified. Among these, an oil-soluble initiator may be exemplified.

As a method for preparing a mixture containing the respective monomer and the like, for example, firstly, the monomer, polymerization initiator and other necessary components are mixed to prepare a mixed liquid of the monomer and the like. A mixing method is not particularly restricted.

Then, a magnetic material is dispersed therein. A known method is applied to disperse a magnetic material in the mixed liquid. That is, a dispersion unit such as a ball mill, a sand mill, an attritor, or a roll mill may be used. When a monomer component is separately polymerized in advance and a magnetic material is dispersed in the resulted polymer, a kneader such as a roll mill, a kneader, a Banbury mixer or an extruder is used.

A method for preparing a mixture is not restricted to the method mentioned above. For example, a mixture obtained by mixing a magnetic material when the mixed liquid is prepared may be used to incorporate a magnetic material at this stage, or the monomer and magnetic material may be mixed at one time to prepare a mixture.

In the next place, the mixture containing the monomer and the like is suspended in an aqueous medium. A suspension process may be conducted as shown below.

That is, in an aqueous medium in which a salt such as an inorganic salt is dissolved and a dispersion stabilizing agent is present, the mixture is added and suspended. As a suspension method, a known suspension method may be used. For example, a mechanical suspension method such as a method in which a specific stirring blade is rotated at a high-speed to disperse the monomer and the like in an aqueous medium like a mixer, a method in which shearing force of a rotor/stator known as a homogenizer is applied to suspend, or a method for suspending by ultrasonic is exemplified.

In the next place, particles containing suspended monomer and magnetic material and the like are suspension-polymerized to obtain magnetic polymer particles. The polymerization reaction may be conducted not only under atmospheric pressure but also under increased pressure. These and other reaction conditions are selected in accordance with characteristics of the magnetic polymer particles to be obtained without particular restriction.

As a reaction condition, there may be exemplified a reaction, for example, at a reaction temperature of 40° C. or more but 100° C. or less for 1 hour or more but 24 hour or less under atmospheric pressure under stirring a suspension liquid in which the suspended particles are dispersed.

Emulsion Aggregation Method (EA Method)

Then, a method for preparing magnetic polymer particles by use of the emulsion aggregation method will be described.

The emulsion aggregation method is conducted in such a manner that a resin dispersion liquid that is dispersed with an ionic surfactant by emulsion polymerization and a colorant (pigment) dispersed with an ionic surfactant having a opposite polarity are mixed and allowed to form hetero-aggregation to form aggregated particles having a size corresponding to a toner diameter, followed by heating the aggregated particles at a temperature equal to or more than a glass transition temperature of the resin to fuse and unite the aggregated particles, further followed by washing and drying to obtain magnetic polymer particles. In general, the emulsion aggregation method has advantages in that an organic solvent is not used, a particle size distribution is narrow a selection range of materials is wide and a shape is readily controlled. Specifically details are disclosed in paragraphs [0028] to [0058] in JP-A No. 2005-31275 or paragraphs [0023] to [0025] in JP-A No. 2007-93669.

In order to control the volume average particle diameter in the range of 1 μm or more but 3 μm or less (about 1 μm or more but about 3 μm or less), when magnetic polymer particles are prepared according to, for example, the emulsion aggregation method (EA method), a high shearing force may be continuously applied during aggregation.

Neutralization

In the exemplary embodiment, a neutralization process may be applied to the particles obtained according to a known method such as a suspension polymerization method or an emulsion aggregation method to change carboxyl groups of a polymer compound (binder component) contained in the particles to a carboxylate salt structure.

In what follows, a neutralization method will be described.

In a neutralization method, for example, the magnetic polymer particles having carboxyl groups may be processed with a basic compound in the presence of water or a mixed solution of water and a water soluble organic solvent. In the exemplary embodiment, a basic compound may be added to an aqueous dispersion liquid of polymer particles, or polymer particles may be processed by mixing with an aqueous solution in which a basic compound is dissolved.

As the basic compound, any of an inorganic basic compound and an organic basic compound may be used. Specific examples thereof include inorganic basic compound such as sodium hydroxide, potassium hydroxide or ammonia; organic basic compound such as tetramethylammonium hydroxide or tetraethylammonium hydroxide; alkylamines such as basic trimethylamine, diethylamine, triethylamine, tripropylamine or tributylamine; and alkanolamines such as monoethanolamine, methylethanolamine, diethanolamine, diisopropanolamine, triethanolamine, dimethylaminoethanol, or morphiline.

The basic compounds may be used singularly or in a combination of at least two thereof. An inorganic basic compound may be used from the viewpoint of ready removability of the basic compound after processing.

In the exemplary embodiment, a usage amount of the basic compound may be in the range of 0.1% by weight or more but 20% by weight or less relative to an aqueous dispersion liquid of polymer particles. In the polymer particles obtained by a treatment with the basic compound, all carboxyl groups may form a salt structure. Usually, in a range of the usage amount, a basic compound is set to be excessive to an amount of carboxyl groups of the polymer particles.

At this time, pH of an aqueous dispersion liquid of polymer particles may be 9 or more or 11 or more. A treatment temperature is not particularly restricted. The aqueous dispersion liquid may be heated to 50° C. or more but 80° C. or less. A treatment time is usually 0.5 hour or more but 24 hour or less without particular restriction. A concentration of polymer particles (aggregated particles) during treatment is usually 1% by weight or more but 50% by weight or less without particular restriction. When polymer particles precipitate during treatment, appropriate stirring may be carried out. After the treatment, the basic compound is removed by washing with water.

-Characteristics of Magnetic Polymer Particles-

A volume average particle diameter of magnetic polymer particles may be in the range of 1 μm or more but 3 μm or less (about 1 μm or more but about 3 μm or less), in the range of 1.1 μm or more but 2.8 μm or less, or in the range of 1.2 μm or more but 2.5 μm or less.

Furthermore, in the magnetic polymer particles, GSDv that is an indicator of a particle size distribution may be 1.30 or less (about 1.30 or less), or 1.10 or more but 1.28 or less.

A volume average particle diameter (D50v) and a particle size distribution of magnetic polymer particles are measured by use of MULTISIZER II (trade name, manufactured by Nikkaki Co., Ltd.). By use of an aperture having an aperture diameter of 30 μm, a particle size distribution of particles having a particle diameter in the range of 0.69 μm or more but 18 μm or less is measured. A number of particles being measured is 10000. A measured particle size distribution is depicted as a cumulative distribution from a smaller volume side relative to divided particle size ranges (channels). A volume average particle diameter D16v in which cumulation is 16%, a volume average particle diameter D50v in which cumulation is 50%, and a volume average particle diameter D84v in which cumulation is 84% are defined. With these values, a volume average particle size distribution index (GSDv) is obtained from $(D84v/D16v)^{0.5}$.

A concentration of magnetic polymer particles in a developer may be in the range of 0.5% by weight or more but 40% by weight or less (about 0.5% by weight or more but about 40% by weight or less), or in the range of 1% by weight or more but 20% by weight or less.

(Dispersion Medium)

Examples of dispersion medium include distilled water, ion-exchanged water, ultrapure water and purified water. The dispersion medium may contain a surfactant, a dispersing agent, a water soluble organic solvent or other additives.

-Surfactant-

As a surfactant, any of known surfactants including an anionic surfactant, a nonionic surfactant, a cationic surfactant or an amphoteric surfactant may be used.

Examples of the anionic surfactant include, for example, alkylbenzene sulfonates, alkylphenyl sulfonates, alkylnaphthalene sulfonates, higher fatty acid salts, sulfuric acid ester salts of higher aliphatic acid ester, sulfonates of higher fatty acid ester, sulfuric acid esters and sulfonates of higher alcohol ether, higher alkyl sulfosuccinates, higher alkyl phosphoric acid ester salts and phosphoric acid ester salts of higher alcohol ethylene oxide adduct.

Examples of the nonionic surfactant include, for example, a polypropylene glycol ethylene oxide adduct, polyoxyethylene alkyl phenyl ethers (polyoxyethylene nonyl phenyl ether, polyoxyethylene octyl phenyl ether, polyoxyethylene dodecyl phenyl ether), polyoxyethylene alkyl ethers (polyoxyethylene oleyl ether, polyoxyethylene cetyl ether, polyoxyethylene lauryl ether), polyoxyethylene fatty acid esters, polyoxyethylene sorbitan fatty acid ester, fatty acid alkylolamides, or oxyethylene adduct of acetylene glycol.

Examples of cationic surfactant include, for example, a tetraalkyl ammonium salt, an alkylamine salt, a benzalkonium salt, an alkyl pyridium salt or an imidazolium salt.

Examples of the amphoteric surfactant include, for example, alkyl dimethylamine oxide or alkyl carboxy betaine.

Examples of the surfactant further include, other than what was mentioned above, for example, a silicone surfactant such as a polysiloxane oxyethylene adduct; a fluorosurfactant such as a perfluoroalkyl carboxylate, a perfluoroalkyl sulfonate, or oxyethylene perfluoroalkyl ether; or a bio-surfactant such as spiculisporic acid, rhamnolipid, or lysolecithin.

-Dispersing Agent-

A dispersing agent is effectively used as long as it is a polymer having a hydrophilic structure and a hydrophobic structure. Examples of the dispersing agent include, for example, a styrene-styrene sulfonic acid copolymer, a styrene-maleic acid copolymer, a styrene-methacrylic acid copolymer, a styrene-acrylic acid copolymer, a vinyl naphthalene-maleic acid copolymer, a vinyl naphthalene-methacrylic acid copolymer, vinyl naphthalene-acrylic acid copolymer, acrylic acid alkyl ester-acrylic acid copolymer, a methacrylic acid alkyl ester-methacrylic acid copolymer, a styrene-methacrylic acid alkyl ester-methacrylic acid copolymer, a styrene-acrylic acid alkyl ester-acrylic acid copolymer, a styrene-methacrylic acid phenyl ester-methacrylic acid copolymer, or a styrene-methacrylic acid cyclohexyl ester-methacrylic acid copolymer. These copolymers may have any structure such as a random copolymer structure, a block copolymer structure and a graft copolymer structure.

These polymers may be copolymerized with a monomer having a polyoxyethylene group or a hydroxy group or a monomer having a cationic functional group, and may have a salt structure with a basic compound in the case of a polymer in which a hydrophilic group is an acidic group.

-Water Soluble Organic Solvent-

A water soluble organic solvent is an organic solvent that does not separate into two phases when it is added to water. Specific examples thereof include, for example, mono or polyhydric alcohols, nitrogen-containing solvents, sulfur-containing solvents or derivatives thereof.

Examples of the polyhydric alcohols include, for example, ethylene glycol, diethylene glycol, propylene glycol, butylene glycol, triethylene glycol, 1,5-pentane diol, 1,2,6-hexane triol, or glycerin.

Examples of the derivatives of polyhydric alcohols include, for example, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, or an ethylene oxide adduct of diglycerin.

Examples of monohydric alcohols include, for example, ethanol, isopropyl alcohol, butyl alcohol or benzyl alcohol.

Examples of the nitrogen-containing solvent include, for example, pyrrolidone, N-methyl-pyrrolidone, cyclohexyl pyrrolidone, or triethanolamine.

Examples of the sulfur-containing solvent include, for example, thiodiethanol, thiodiglycerol, sulfolane, or dimethyl sulfoxide.

Examples of the water soluble organic solvent include, other than those exemplified above, propylene carbonate or ethylene carbonate.

An addition amount when the water soluble organic solvent is added may be 30% by weight or less, or 10% by weight or less, relative to a total dispersion medium.

-Other Additives-

Into a dispersion medium, a compound of alkali metal such as potassium hydroxide, sodium hydroxide or lithium hydroxide; a nitrogen-containing compound such as ammonium hydroxide, triethanolamine, diethanolamine, ethanolamine, or 2-amino-2-methyl-1-propanol; a compound of alkaline earth metal such as calcium hydroxide; an acid such as sulfuric acid, hydrochloric acid or nitric acid; or a salt between a strong acid and a weak alkali such as ammonium sulfate may be added.

Other than what was mentioned above, a benzoic acid, dichlorophen, hexachlorophene, or sorbic acid may also be added. Furthermore, an antioxidant, a viscosity controlling agent, a conductive agent, a UV-absorbent or a chelating agent may also be added.

(Method for Producing Developer)

A developer according to the exemplary embodiment may be produced according to a procedure shown below without restricting thereto.

In the first place, a dispersion medium containing water that is a main solvent and the respective additives is prepared by use of a magnetic stirrer, followed by dispersing the magnetic polymer particles therein. A known method may be used to disperse. That is, a dispersing device such as a ball mill, a sand mill, an attritor or a roll mill is used. Furthermore, a method in which a specific stirring blade is rotated at a high-speed to disperse like a mixer, a method in which a shearing force of a rotor/stator known as a homogenizer is used to disperse, or a method in which ultrasonic is used to disperse may be used.

A microscope is used to confirm that a sampled dispersion liquid is in a mono-dispersed state of the magnetic polymer particles in the liquid, followed by adding additives such as an antiseptic agent, further followed by confirming that the additives are dissolved. The resulted dispersion liquid is filtered with a mesh having, for example, a pore diameter of 100 μm to remove foreign matters and coarse particles, thereby a liquid developer according to the exemplary embodiment is obtained.

(Characteristics of Developer)

-Surface Tension of Developer-

Surface tension of a developer may be 27 mN/m or more but 42 mN/m or less, 28 mN/m or more but 41 mN/m or less, or 30 mN/m or more but 39 mN/m or less.

The surface tension of a developer depends on a composition of the developer; accordingly, the surface tension of a developer may be controlled by adjusting a composition of the developer. Specifically, for example, a method in which in accordance with the characteristics of the magnetic polymer particles, a species and a concentration of a surfactant are adjusted, thereby surface tension of a developer is controlled is exemplified.

Examples of species of a surfactant for controlling the surface tension of the developer in the above range include, among the surfactants mentioned above, for example, an alkylbenzene sulfonate, an alkylphenyl sulfonate, a higher fatty acid salt, polyoxyethylene alkyl ether, or polyoxyethylene alkyl phenyl ether. Among these, a higher fatty acid salt, polyoxyethylene alkyl ether, or polyoxyethylene alkyl phenyl ether may be exemplified.

As an addition amount of the surfactant for controlling the surface tension of the developer in the above range, relative to a total developer, for example, a range of 0.001% by weight or more but 15% by weight or less is exemplified, a range of 0.01% by weight or more but 8% by weight or less may be exemplified, and a range of 0.05% by weight or more but 3% by weight or less may be exemplified.

-Viscosity of Developer-

The viscosity of a developer may be 0.9 mPa·s or more but 10.0 mPa·s or less, 0.9 mPa·s or more but 5 mPa·s or less, or 0.9 mPa·s or more but 4 mPa·s or less.

The viscosity of a developer depends on a composition of the developer; accordingly, the viscosity of a developer may be controlled by adjusting a composition of the developer. Specifically, a method in which the viscosity of a developer is controlled by selecting a species of a surfactant, controlling a concentration of a surfactant, or by adding a viscosity controller is exemplified.

<Process Cartridge, Image Forming Apparatus>

An image forming apparatus of the exemplary embodiment is a magnetography image forming apparatus. The magnetography method is a method in which a magnetic latent image of a pattern such as a character or an image is formed and the magnetic latent image is visualized with a magnetic toner (magnetic polymer particles) to obtain a hard copy.

An image forming apparatus according to the exemplary embodiment specifically includes a latent image holding member (hereinafter, in some cases, referred to as "image holding member"), a magnetic latent image forming unit for forming a magnetic latent image on the magnetic latent image holding member, a developer storing unit for storing a developer according to the exemplary embodiment, a developer feeding unit for feeding the developer to the magnetic latent image holding member on which the magnetic latent image has been formed to visualize the magnetic latent image as a developed image, a transfer unit for transferring the developed image to a recording medium, and a degaussing unit for degaussing the magnetic latent image on the magnetic latent image holding member.

In the exemplary embodiment, a surface of a image holding member may be water-repellent. The image forming apparatus may further include a squeeze roller for removing a solvent remaining on the image holding member.

FIG. 1 is a schematic configurational diagram showing one example of an image forming apparatus of the exemplary embodiment. An image forming apparatus 100 includes a magnetic drum (magnetic latent image holding member) 10, a magnetic head (magnetic latent image forming unit) 12, a developing unit (developer storing unit and developer feeding unit) 14, an intermediate transfer medium (transfer unit) 16, a cleaner 18, a degaussing unit 20, and a transfer/fixing roller (transfer unit) 28. The magnetic drum 10 has a cylindrical columnar shape, and, around an external periphery of the magnetic drum 10, the magnetic head 12, a developing unit 14, the intermediate transfer medium 16, the cleaner 18 and the degaussing unit 20 are sequentially disposed.

In what follows, an operation of the image forming apparatus 100 will be briefly described.

In the beginning, a magnetic head 12 is connected to, for example, a not shown information equipment and receives binarized image data from the information equipment. The magnetic head 12 radiates magnetic lines while scanning on a side surface of the magnetic drum 10 to form a magnetic latent image 22 on the magnetic drum 10. In FIG. 1, a magnetic latent image 22 is shown by a slashed portion in the magnetic drum 10.

The developing unit 14 includes a developing roller (developer feeding unit) 14*a* and a developer storing vessel (developer storing unit) 14*b*. The developing roller 14*a* is disposed so as to be partially dipped in a liquid developer (developer) 24 stored in the developer storing vessel 14*b*.

The liquid developer 24 fed to the developing roller 14*a* is conveyed to the magnetic drum 10 with a feeding amount thereof being restricted to a definite feeding amount by a restricting member described below and fed to the magnetic latent image 22 at a position where the developing roller 14*a* and the magnetic drum 10 come close (or are brought into contact) with each other. Thereby, the magnetic latent image 22 is visualized to form a toner image 26.

The developed toner image 26 is transported by the magnetic drum 10 rotating in a direction of an arrow mark B in the drawing and transferred to a paper sheet (recording medium) 30. However, in the exemplary embodiment, the toner image is once transferred to an intermediate transfer medium 16. In the exemplary embodiment, a configuration in which the intermediate transfer medium 16 is employed is adopted. However, a configuration where, without using the intermediate transfer medium 16, a toner image is directly transferred from the magnetic drum 10 to a paper sheet 30 may be adopted.

When a toner image is transferred to the intermediate transfer medium 16, shearing transfer (non-electric field transfer) may be conducted because the magnetic polymer particles hardly have charges. Specifically, a magnetic drum 10 rotating in a direction of an arrow mark B and an intermediate transfer medium 16 rotating in a direction of an arrow mark C are brought into contact with a contact portion (a contact surface having a contact width in a traveling direction) to transfer the toner image 26 onto the intermediate transfer medium by an adsorption force equal to or more than the magnetic force between the magnetic drum 10 and the toner image 26. At this time, a difference may be imparted between peripheral speeds of the magnetic drum 10 and the intermediate transfer medium 16.

In the next place, the toner image 26 transported in a direction of an arrow mark C by the intermediate transfer medium 16 is transferred and fixed on a paper sheet 30 at a contact position between the intermediate transfer medium 16 and the transfer/fixing roller 28. Specifically, the transfer/fixing roller 28 and the intermediate transfer medium 16 nip a paper sheet 30, the toner image 26 on the intermediate transfer medium 16 is brought into contact with the paper sheet 30, and thereby, the toner image 26 is transferred and fixed.

When the toner image is fixed, depending on the toner characteristics, the toner image may be fixed by only pressing or by pressing and heating by disposing a heater to the transfer/fixing roller 28.

On the other hand, in the magnetic drum 10 that has transferred the toner image 26 to the intermediate transfer medium 16, a transfer residual toner is transported to a contact position with a cleaner 18 and recovered by the cleaner 18. After cleaning, the magnetic drum 10 moves by rotating to a degaussing position with the magnetic latent image 22 held thereon.

A degaussing unit 20 erases the magnetic latent image 22 formed on the magnetic drum 10. The cleaner 18 and degaussing unit 20 return the magnetic drum 10 to a state in which a magnetized state of a magnetic layer has no unevenness before image formation. By repeating the operations, images continuously transported from the information equipment are continuously formed in a short time. All of the magnetic head 12, developing unit 14, intermediate transfer medium 16, transfer/fixing roller 28, cleaner 18 and degaussing unit 20 provided to the image forming apparatus 100 are operated synchronously with a rate of rotation of the magnetic drum 10.

In the next place, the respective configurations of the image forming apparatus of the exemplary embodiment will be described.

(Magnetic Latent Image-holding Member)

A magnetic drum (magnetic latent image-holding member) 10 is configured in such a manner that, on a drum made of metal such as aluminum, an underlayer made of Ni or Ni—P is formed at a thickness of substantially 1 μm or more but 30 μm or less, thereon a magnetic recording layer made of Co—Ni, Co—P, Co—Ni—P, Co—Zn—P or Co—Ni—Zn—P is formed at a thickness of 0.1 μm or more but 10 μm or less, and further thereon a protective layer made of Ni or Ni—P is formed at a thickness of 0.1 μm or more but 5 μm or less. The underlayer may be densely plated without unevenness. Other than plating, a sputtering or vapor deposition method may also be used. Furthermore, the underlayer and protective layer may be non-magnetic. A surface of each of layers may maintain surface precision by polishing with tape.

A film thickness of the magnetic recording layer may be in the range of 0.1 μm or more but 10 μm or less. Concerning the magnetic characteristics of the magnetic recording layer, a coercive force may be 16000 A/m or more but 80000 A/m or less (200 Oe or more but 1000 Oe or less), and a residual magnetic flux density may be 100 mT or more but 200 mT or less (1000 G or more but 2000 G or less).

A configuration of a magnetic drum 10 in the case of a horizontal magnetic recording system has been mentioned above. In the case of a vertical magnetic recording system, a recording layer made of Co—Ni—P may be formed on a non-magnetic layer or a soft magnetic layer high in the magnetic permeability may be formed under the recording layer without restricting thereto. A magnetic latent image holding member may be formed into a belt shape without restricting to a drum shape in the exemplary embodiment.

In the exemplary embodiment, a water-repellent magnetic drum 10 may be used. The water-repelling property means a property that repels water and specifically means that a contact angle with pure water is 70° or more.

In the exemplary embodiment, a contact angle with pure water of the magnetic drum 10 may be 70° or more, or 100° or more.

A contact angle of a surface of the magnetic drum 10 is obtained by measuring a contact angle 15 sec after 3.1 μl of pure water is dropped on a surface of a magnetic drum, by use of a contact angle meter (trade name: CA-X, manufactured by Kyowa Interface Science Co., Ltd.) and under an environment of 25° C. and 50% RH. A measurement is conducted at four points in a peripheral direction of each of an end portion and a center portion, and an average value thereof is referred to as a contact angle.

In order to make a surface of the magnetic drum 10 into a surface having the above contact angle, a surface of the magnetic drum configured as mentioned above may be subjected to surface-coating.

Examples of the surface-coating include fluorine lubrication plating or coating that uses a polymer containing fluorine atoms or silicon atoms. The fluorine lubricating plating is a functional plating in which a fluorine resin (polytetrafluoroethylene: PTFE) is composited and coprecipitated with electroless nickel plating. In a formed film, PTFE particles are precipitated, and thus, the characteristics of the electroless nickel plating and the PTFE resin are combined therein.

Furthermore, examples of the coating using a polymer that contains fluorine atoms or silicon atoms include for example, coating on the surface of the protective layer with a polymer having a fluorine-containing cyclic structure, a copolymer of fluoro-olefin and vinyl ether, or a photopolymerization type fluorine resin composition, and sputtering of a fluorine-containing polymer on the surface of the protective layer, whereby the entire surface of the protective layer may be covered.

Among these examples of surface coating, the fluorine lubricating plating may be exemplified. The aforementioned fluorine lubricating plating or fluorine resin coating may be applied on the formed protective layer, or the layer formed by fluorine lubricating plating may be used as it is as the protective layer.

A film thickness of the surface layer formed by the surface coating may be 0.1 μm or more but 5 μm or less, or 0.3 μm or more but 3 μm or less.

(Magnetic Latent Image Forming Unit)

A magnetic latent image forming unit is fundamentally made of a magnetic head 12 and a driving circuit thereof. As the magnetic head 12, a full line magnetic head and a multi-channel magnetic head are mainly exemplified. In the case of the full-line type magnetic head, it is not necessary to scan the magnetic head 12, but in the case of the multi-channel type magnetic head, it is necessary to scan the magnetic head 12 relative to the magnetic drum 10. Examples of scanning method include a serial scanning method and a helical scanning method. In the helical scan, when the rotational speed of the magnetic drum 10 is particularly changed only in the latent image forming process, the recording speed may be increased.

On the other hand, in the case of the fill-line type magnetic head, for example, when the resolution thereof is set at 600 dpi, a head including 500 channels or more is required in order to cover the recording width in a width direction of an A4-size paper sheet. Furthermore, in order to form the full-line configuration, overlapping between head cores becomes necessary. However, as the resolution becomes higher, a track pitch becomes narrower. Therefore, a coil being inserted in the head core needs to be made thinner, and, for example, a flat sheet coil is used.

When a current is flowed through a coil of each of channels of a magnetic head 12, leakage magnetic flux is generated from an end of a magnetic pole, and thereby, a magnetic recording medium is magnetized to form a magnetic latent image. Output from the magnetic head 12 is required to be two times or more but three times or less the coercive force of the magnetic recording layer in the magnetic drum 10. There is no possibility that the formed magnetic latent image vanish unless it is erased by a degaussing unit 20, and a multiple copy function is provided when respective processes of development, transfer, fixing and cleaning are performed repeatedly. The magnetic latent image is not easily affected by humidity, and therefore, it is excellent in the environmental stability compared with an electrostatic system.

(Developer Storage Unit, Developer Feeding Unit)

Figure 2:
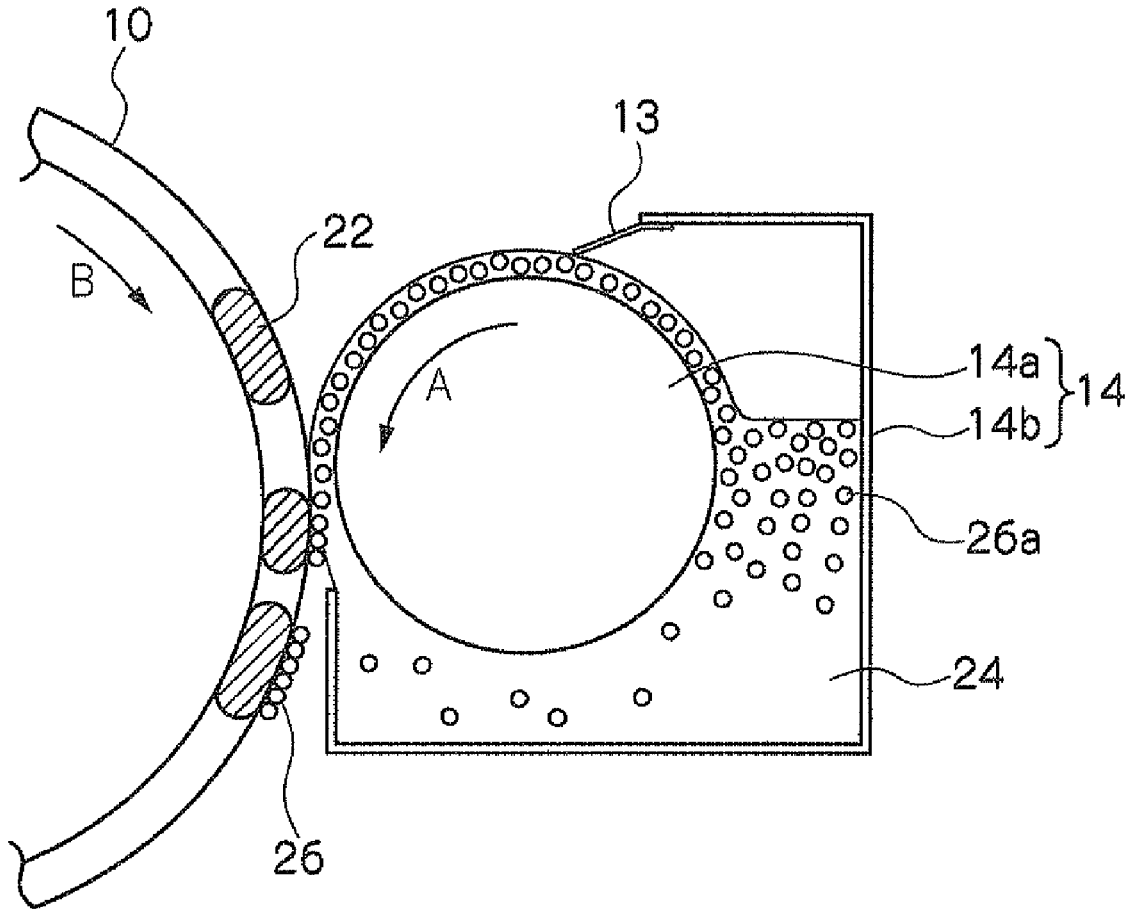
FIG. 2 is an enlarged schematic diagram of a development region in one example of an image forming apparatus according to the exemplary embodiment.

In FIG. 2, an enlarged schematic diagram of a developing area in FIG. 1 is shown.

A developing unit 14 includes a developer storage vessel **14*b* and a developing roller 14*a* that feeds a liquid developer 24 stored in the developer storage vessel 14*b* to a magnetic drum 10 in a toner feeding area (hereinafter, in some cases, referred to as "feeding area"). As shown in FIG. 2, the developing roller 14*a* holds a lamellar liquid developer 24 on a peripheral surface thereof and is disposed at a position separated from the magnetic drum 11 (for example, the magnetic drum and the developing unit form a process cartridge). At an upper stream position in the feeding area, a restriction member 13 for maintaining a layer thickness of the liquid developer 24 at a predetermined thickness is disposed. The restriction member 13 is a planar member extending over an entire width in an axial line direction of the developing roller 14*a* and one brim portion thereof is disposed so as to separate from a peripheral surface of the developing roller 14*a*** by a distance corresponding to a toner layer thickness.

In the developing unit 14, the liquid developer 24 that contains toner particles (magnetic polymer particles) **26*a* and a dispersion medium is stored in the developer storage vessel 14*b*. The liquid developer storage vessel 14*b* may be constituted so that the liquid developer 24 may be fed from a not shown liquid developer cartridge. The liquid developer cartridge may be configured detachable from the image forming apparatus so as to be able to exchange when a residue of the liquid developer 24** comes to an end.

The liquid developer 24 is fed from the developer storage vessel **14*b* to the developing roller 14*a*. Furthermore, for example, a stirring member may be disposed inside of the developer storage vessel 14*b*** to keep stirring at a determined rotation speed.

Although not shown in FIG. 2, a feed roller may be provided, which rotates in contact with or in proximity with the developing roller **14*a*, to feed the liquid developer to the developing roller 14*a***.

The developing roller **14*a* is provided with the plural magnetic poles including south poles and north poles inside thereof along a peripheral direction, and these magnetic poles are fixed so as not to rotate together with the developing roller 14*a*. One of these magnetic poles is particularly disposed between the restriction member 13 and the feeding area. Accordingly, the liquid developer 24 that contains a magnetic toner held by the developing roller 14*a* is held by magnetic force lines of these magnetic poles (a development magnetic field) and is conveyed toward a direction of the magnetic drum 10**.

The developing roller 14*a* does not need to be a magnetic roller if the roller surface itself has conveying force of the liquid developer and for example, an anilox roller or a sponge roller may also be used.

The restriction member 13 is disposed at a position between a position where the developing roller 14*a* holds a liquid developer 24 of the developer storage vessel 14*b* as described above and a position where the liquid developer 24 is fed to the magnetic drum 10. An amount of the liquid developer 24 fed to the magnet latent image 22 is determined based on a gap formed by the restriction member 13 and the developing roller 14*a*. The material of the restriction member 13 may be rubber or phosphor bronze. The liquid developer 24 that is restricted to a fixed feed amount by the restriction member 13 is conveyed to the magnetic drum 10, and is fed to the magnetic latent image 22. As a result, the magnetic latent image 22 is visualized to form a toner image 26.

Furthermore, at the development described above, the toner particles are magnetic toner; accordingly, development may be performed without applying a magnetic field to the developing roller 14*a*. However, the development may be performed with a magnetic field applied to the developing roller 14*a*.

(Transfer Unit, Fixing Unit)

The toner image visualized by the developing unit 14 is transferred to the paper sheet 30 by the transfer unit. As described above, in the exemplary embodiment, a method is used where, without directly transferring the toner image onto the paper sheet from the magnetic drum 10, the toner image is once transferred to the intermediate transfer medium 16, thereafter the toner image is transferred and fixed on the paper sheet 30. First, the transfer to the intermediate transfer medium 16 will be described.

The intermediate transfer medium 16 comes into contact with the magnetic drum 10 to transfer the toner image. Examples of the transfer method generally include an electrostatic transfer method, a pressure transfer method, or an electrostatic pressure method using both of the aforementioned methods in combination. However, as mentioned above, in the exemplary embodiment, the toner particles have no charge; accordingly, the electrostatic transfer method or the electrostatic pressure method may not be used. On the other hand, the pressure transfer method is a method in which, usually due to pressure between the magnetic drum 10 and the transfer medium, the toner image is attached and transferred to a surface of the transfer medium with a toner image being subjecting to plastic deformation, and this method may be used together with shearing transfer.

In the exemplary embodiment, as described above, an adsorption force equal to or more than a magnetic force with the magnetic drum 10 is applied to the toner image 26 on the magnetic drum 10 to transfer the toner image 26 to the intermediate transfer medium; accordingly, it is suitable to impart tackiness to the intermediate transfer medium 16 to perform transfer by tackiness. Accordingly, for example, a silicone rubber layer having a low degree of hardness may be formed on a surface of the intermediate transfer medium 16.

In the next place, the toner image 26 transferred to the intermediate transfer medium 16 is transferred to the paper sheet.

The transfer/fixing roller 28 is disposed on an opposite side of the magnetic drum 10 with the intermediate transfer medium 16 in FIG. 1 intervening therebetween so as to form a contact portion to the intermediate transfer medium 16. The paper sheet 30 is fed into a contact portion between the intermediate transfer medium 16 and the transfer/fixing roller 28 in synchronized timing with the toner image 26 on the intermediate transfer medium 16. The transfer/fixing roller 28 is formed by, for example, a stainless steel base material, a silicone rubber layer, or a fluorine-containing rubber layer. When the paper sheet 30 passing through the contact portion is pressed on the intermediate transfer medium 16 to bring into contact therewith, a toner image on the intermediate transfer medium 16 is transferred to the paper sheet 30.

In the exemplary embodiment, simultaneously with transfer of the toner image 26 from the intermediate transfer medium 16 to the paper sheet 30, the toner image 26 is fixed on the paper sheet 30. Specifically, when the intermediate transfer medium 16 is formed in the shape of a roller as shown in FIG. 1, the intermediate transfer medium 16 forms a roller pair together with the transfer/fixing roller 28. Accordingly, the intermediate transfer medium 16 and the transfer/fixing roller 28 respectively have structures of a fixing roller and a pressing roller in a fixing unit; as the result, a fixing function is exerted. That is to say, when the paper sheet 30 passes through the contact portion, a toner image 26 is transferred and, simultaneously therewith, pressed by the transfer/fixing roller 28 against the intermediate transfer medium 16, thereby toner particles that form the toner image 26 are softened and infiltrated into fiber of the paper sheet 30 to form a fixed image 29.

As mentioned above, by disposing a heater to, for example, the transfer/fixing roller 28 to heat the toner image, the toner image may be melted and infiltrated into fiber of the paper sheet 30 to be fixed to form a fixed image 29. In this state, even when the paper sheet 30 is bent, or an adhesive tape is applied to the image and thereafter stripped, the fixed image 29 may not be peeled off.

In the exemplary embodiment, transfer of an image to the paper sheet 30 and fixing of the image thereon are performed simultaneously. However, the transfer process and fixing process may be separated from each other, and fixing process may be performed after the transfer process. In this case, the transfer roller that transfers a toner image from the magnetic drum 10 has a function according to the intermediate transfer medium 16.

(Cleaner)

On the other hand, in the case where the transfer efficiency of a toner image from the magnetic drum 10 to the intermediate transfer medium 16 does not reach 100%, the toner image 26 partially remains on the magnetic drum 10 after transfer of the toner image. A cleaner 18 is used to remove the residual portion of the toner image. Basically, the cleaner 18 is formed from a cleaning blade made from rubber and a container of remaining magnetic toner.

On the contrary, in the case where the transfer efficiency approximates 100% and the residual toner is insignificant, it is not necessary to provide the cleaner 18.

(Degaussing Unit)

In the case where a new image is formed again, the magnetic latent image needs to be erased before a magnetic latent image is formed with the magnetic head 12. The degaussing unit 20 includes a permanent magnet system or an electromagnet system. In the case of the permanent magnet system, the magnetic drum 10 is magnetized in a circumferential direction thereof so as to inhibit local leakage of a magnetic flux from occurring. However, in the case where the magnetic latent image is not erased, it is necessary for the degaussing unit 20 to be moved with respect to the magnetic drum 10 to increase a magnetic distance, thus making the degaussing magnetic field weak.

An electromagnet system is made of a yoke and a coil and necessitates a current flow. In the case where the magnetic latent image does not need to be erased, the current is turned out to make the degaussing magnetic field zero.

In the exemplary embodiment, each of the aforementioned permanent magnet system and electromagnet system may be used.

EXAMPLES

In what follows, the invention will be more specifically described with reference to Examples. However, Examples are only for description and the invention is not at all restricted to Examples shown below. "Parts" and "%" in Examples, respectively, represent "parts by weight" and "% by weight", unless otherwise stated.

<Preparation of Colorant Dispersion Liquid M1>

| | |
|---|---|
| Magenta pigment (C.I. Pigment Red 122) | 50 parts |
| Nonionic surfactant (trade name: NONIPOL 400, manufactured by Sanyo Chemical Industries, Ltd.) | 5 parts |
| Ion exchanged water | 200 parts |

These are mixed and dissolved, followed by dispersing for 1 hour by use of a high-pressure impact dispersing device ULTIMIZER (trade name: HJP30006, manufactured by Sugino Machine Ltd.), and thereby a colorant dispersion liquid M1 in which a colorant is dispersed is prepared. A volume average particle diameter of the colorant in the colorant dispersion liquid M1 is 125 nm.

<Preparation of Colorant Dispersion Liquid Y1>

A colorant dispersion liquid Y1 is obtained in a manner substantially similar to a method described in the preparation of colorant dispersion liquid M1 except that in the preparation of colorant dispersion liquid M1 the colorant is changed to C.I. Pigment Yellow 74 (trade name: FAST YELLOW 7410, manufactured by Sanyo Color Works, Ltd.). A volume average particle diameter of the colorant in the colorant dispersion liquid Y1 is 225 nm.

<Preparation of Colorant Dispersion Liquid B1>

A colorant dispersion liquid B1 is obtained in a manner substantially similar to a method described in the preparation of colorant dispersion liquid M1 except that in the preparation of colorant dispersion liquid M1 the colorant is changed to C.I. Pigment Blue 15:3 (trade name: FASTOGEN BLUE CT-BX130, manufactured by Dainippon Ink & Chemicals, Incorporated). A volume average particle diameter of the colorant in the colorant dispersion liquid B1 is 250 nm.

Example 1

-Preparation of YIG Dispersion Liquid 1-

In the beginning, 400 parts of yttrium iron garnet $Y_3Fe_5O_{12}$ (volume average particle diameter: 2.0 μm, manufactured by Kojundo Kagaku Co., Ltd.) as YIG particles are dispersed in a dispersion medium obtained by adding 4 parts of anionic surfactant (trade name: DEMOL EP, manufactured by Kao Corporation) in 400 parts of pure water, followed by pulverizing for 45 min by use of a beads mill (trade name: LMZO6, manufactured by Asizawa Finetech Ltd.,) with beads having a diameter of 0.3 mm. YIG particles taken out from the beads mill are subjected to decantation and centrifugal separation to remove microparticles and coarse particles, and thereby a YIG dispersion liquid 1 having a solid concentration of 10% is obtained. A volume average particle diameter of YIG is 0.4 μm.

-Preparation of Resin Dispersion Liquid 1-

| | |
|---|---|
| Styrene | 58.5 parts |
| N-butyl methacrylate | 36.5 parts |
| Mono-2-(methacryloyloxy)ethyl phthalate | 5.0 parts |
| α-methylstyrene dimer | 5.0 parts |
| N-octyl-3-mercaptopropionate | 2.5 parts |

A solution obtained by mixing and dissolving these components is added to a solution in which 6 parts of nonionic surfactant (trade name: NONIPOL 400, manufactured by Sanyo Chemical Industries Ltd.) and 10 parts of anionic surfactant (trade name: NSOGEN SC, manufactured by Daiichi Kogyo Seiyaku Co., Ltd.) are dissolved in 550 parts of ion exchanged water, followed by dispersing for 10 min in a flask to emulsify, followed by adding thereto 50 parts of ion exchanged water in which 4 parts of ammonium persulfate are dissolved under slowly mixing, further followed by substituting with nitrogen. Thereafter, with the flask being stirred, the content is heated to 70° C. in an oil bath, followed by continuing an emulsification polymerization as it is for 10 hr. Thereby, an anionic resin dispersion liquid 1 having a center diameter (volume average particle diameter) of 250 nm, a glass transition temperature of 45° C. and a weight average molecular weight Mw of 35000 is obtained.

-Production of Magnetic Polymer Particles/Yellow Color-

| | |
|---|---|
| Resin dispersion liquid 1 | 120 parts |
| Colorant dispersion liquid Y1 | 12 parts |
| YIG dispersion liquid 1 | 12 parts |

In addition to the foregoing components, 180 parts of ion exchanged water and 1N nitric acid are added to control the pH of a dispersion liquid to 2.5. While heating at 45° C. under stirring with a homomixer at 4000 rpm in a cylindrical flask, 1.0 parts of polyaluminum chloride is added, followed by stirring in this state for 2 hr. By observing with an optical microscope, it is confirmed that aggregated particles of 2 μm are generated.

Thereafter, the pH of the system is controlled to 6.5 with a 0.5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, the volume average particle diameter is confirmed to be 2.2 μm. The GSDv that is an indicator of a particle size distribution is 1.23.

Thereafter a solid/liquid separation is performed by centrifugation. The resulted particles are controlled to a solid concentration of 10%. To 100 parts of this dispersion liquid, 2 parts of a 1N aqueous solution of NaOH is added, followed by stirring for 24 hour to neutralize. The resulted particles are washed with 1 L of ion exchanged water three times, followed by removing particles not containing magnetic powder and particles excessively containing magnetic powder by use of MAGNET SEPARATOR MS0 (trade name, manufactured by Noritake Co.) under a condition of processing speed of 4.41/min. The resulted particles are vacuum dried at 40° C. and thereby magnetic polymer particles (magnetic toner) having a volume average particle diameter of 2.2 μm is obtained.

-Measurement of Toner Characteristics/Content of Magnetic Material-

From a magnetization curve of the magnetic polymer particles measured by a vibration sample magnetometer (VSM) and a magnetization curve of YIG alone, content of the magnetic material in the magnetic toner is calculated. Results are shown in Tables 1 and 2.

-Measurement of Toner Characteristics/Content of Colorant-

Dried magnetic polymer particles are charged in a cylindrical filter paper and subjected to a Soxhlet extraction with methyl ethyl ketone for 24 hr. From an amount of the colorant and an amount of the magnetic material, which remain on the cylindrical filter paper, the content of the magnetic material calculated above is subtracted to calculate a concentration of the colorant in the magnetic toner. Results are shown in Tables 1 and 2.

-Preparation of Liquid Developer-

To 5 parts of the magnetic toner and 0.5 parts of polyoxyethylene (20) cetyl ether (manufactured by Wako Pure Chemical Industries Ltd.), 94.5 parts of ion exchanged water are added, followed by stirring and dispersing by a ball mill for 3 hr, and thereby a liquid developer is obtained.

[Evaluation of Developer Characteristics]

-Evaluation of Fog-

An image forming apparatus 100 having a configuration shown in FIG. 1 is prepared and the liquid developer is used as a developer. A magnetic drum 10 is configured in such a manner that, on an aluminum drum, Ni—P is formed at a film thickness of 15 μm as an underlayer, Co—Ni—P is plated at a film thickness of 0.8 μm as a magnetic recording layer, and further thereon a protective layer having a film thickness of 1.5 μm is formed by fluorine lubricating plating of Ni—P—PTFE particles. A coercive force of the magnetic recording layer is 400 Oe and a residual magnetic flux density is 7000 G. A contact angle of pure water at 25° C. and 50% RH to a surface of the magnetic drum 10 is 110°. As a magnetic head 12, a 4 channel full-line magnetic head that is made of Mn—Zn ferrite and forms pixels corresponding to 600 dpi (dpi: dots per inch) is prepared.

As a developing unit 14, a developing unit 14 that includes a magnet roll where cylindrical permanent magnets are concentrically disposed inside of an aluminum nonmagnetic sleeve as a developing roller 14*a* and a developer storage vessel 14*b* inside of which a stirring blade for stirring a liquid developer is disposed is used. The liquid developer is charged into the developer storage vessel 14*b* and a developing unit 14 is disposed so that a gap between a surface of the nonmagnetic sleeve and a surface of the magnetic drum 10 may be 50 μm.

As an intermediate transfer medium 16, an aluminum intermediate transfer drum that has a silicone rubber layer having a thickness of 7.5 mm on a surface thereof and rotates at a circumferential speed same as the magnetic drum 10 is used. As a transfer/fixing roller 28, an elastic roll where, on an outer periphery of a stainless core material, a silicone rubber layer and a fluororubber layer are coated in this order, is used, and the elastic roll is heated by a heater so that a surface temperature may be 170° C.

With an image forming apparatus 100 configured as mentioned above, printing conditions are set as shown below.

Linear speed of magnetic drum: 100 mm/sec

Ratio of circumferential speed of developing roller/circumferential speed of magnetic drum: 1.2

Transfer condition (intermediate transfer): pressure against a magnetic drum of an intermediate transfer medium is set at 0.147 MPa (1.5 kgf/cm$^2$).

Transfer/fixing condition: pressure of a transfer/fixing roller to an intermediate transfer medium is set at 0.245 MPa (2.5 kgf/cm$^2$).

Under the conditions mentioned above, a magnetic head 12 is used to form a magnetic latent image (corresponding to halftone) having a stripe pattern of 30 μm/line on a magnetic drum 10, followed by developing by bringing a liquid developer into contact with the magnetic latent image by the developing roller. Then, the developed toner image is transferred to the intermediate transfer medium 16, followed by transferring and fixing on a recording paper sheet, thereby an image is obtained. The resulted image is observed and evaluated. An evaluation criterion is as follows. That is, when a line width of a fixed image measured with a microscope is 45 μm or less, a developing property is judged as good.

-Evaluation of Color-

The resulted magnetic toner is formed in layer at 4.0 g/m$^2$ and thermally fixed (temperature: 170° C.), and thereby a color sample is prepared. Then, the color sample is subjected to colorimetry by use of a reflective densitometer X-rite 939 (trade name, manufactured by X-rite Inc.) to investigate a CIE 1976 (L*a*b*) colorimetric system. The CIE 1976 (L*a*b*) calorimetric system is a color space recommended by CIE (Commission internationale de le'clairage) in 1976 and defined as JIS Z 8729 in Japanese Industrial Standard.

An L* value of the CIE 1976 (L*a*b*) calorimetric system is shown, and a color difference ΔE between the investigated CIE 1976 (L*a*b*) calorimetric system and a color sample of a toner separately prepared without containing a magnetic material is obtained and used as an indicator of coloring property.

Results are shown in Tables 1 and 2.

Example 2

Magnetic polymer particles (magnetic toner) are prepared in a manner substantially similar to a method described in Example 1 except that a composition of "Production of Magnetic Polymer Particles/Yellow Color" in Example 1 is changed as shown below so that content of magnetic material may be a numerical value shown in Table 1 and 2. A volume average particle diameter is measured according to the foregoing method by use of Coulter Multisizer II and confirmed to be 2.3 μm. GSDv that is an indicator of a particle size distribution is 1.21.

Furthermore, a liquid developer is prepared and evaluated in a manner substantially similar to a method described in Example 1.

-Production of Magnetic Polymer Particles/Yellow Color-

| | |
|---|---|
| Resin dispersion liquid 1 | 120 parts |
| Colorant dispersion liquid Y1 | 14 parts |
| YIG dispersion liquid 1 | 15 parts |

Example 3

-Production of Magnetic Polymer Particles/Magenta Color-

| | |
|---|---|
| Resin dispersion liquid 1 | 120 parts |
| Colorant dispersion liquid M1 | 21 parts |
| YIG dispersion liquid 1 | 14 parts |

In addition to the foregoing components, 180 parts of ion exchanged water and 1N nitric acid are added to adjust the pH of a dispersion liquid to 2.5. While heating at 45° C. under stirring with a homomixer at 4000 rpm in a cylindrical flask, 1.0 parts of polyaluminum chloride is added, followed by stirring in this state for 2 hr. It is confirmed by observing with an optical microscope that aggregated particles of 2 μm are generated.

Thereafter, the pH of the system is controlled to 6.5 with a 0.5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, the volume average particle diameter is confirmed to be 2.3 μm. The GSDv that is an indicator of a particle size distribution is 1.24.

Thereafter, according to a method described in Example 1, magnetic polymer particles (magnetic toner) having a volume average particle diameter of 2.3 μm are obtained.

Furthermore, a liquid developer is prepared and evaluated according to a method described in Example 1.

Example 4

-Production of Magnetic Polymer Particles/Red Color-

| | |
|---|---|
| Resin dispersion liquid 1 | 120 parts |
| Colorant dispersion liquid M1 | 11 parts |
| Colorant dispersion liquid Y1 | 7 parts |
| YIG dispersion liquid 1 | 12 parts |

In addition to the foregoing components, 180 parts of ion exchanged water and 1N nitric acid are added to adjust the pH of a dispersion liquid to 2.5. While heating at 45° C. under stirring with a homomixer at 4000 rpm in a cylindrical flask, 1.0 parts of polyaluminum chloride is added, followed by stirring in this state for 2 hr. It is confirmed by observing with an optical microscope that aggregated particles of 2 μm are generated.

Thereafter, the pH of the system is adjusted to 6.5 with a 0.5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, the volume average particle diameter is confirmed to be 2.1 μm. The GSDv that is an indicator of a particle size distribution is 1.25.

Thereafter, according to a method described in Example 1, magnetic polymer particles (magnetic toner) having a volume average particle diameter of 2.1 μm are obtained.

Furthermore, a liquid developer is prepared and evaluated according to a method described in Example 1.

Example 5

-Production of Magnetic Polymer Particles/Green Color-

| | |
|---|---|
| Resin dispersion liquid 1 | 120 parts |
| Colorant dispersion liquid Y1 | 7 parts |
| Colorant dispersion liquid B1 | 8 parts |
| YIG dispersion liquid 1 | 15 parts |

In addition to the foregoing components, 180 parts of ion exchanged water and 1N nitric acid are added to adjust the pH of a dispersion liquid to 2.5. While heating at 45° C. under stirring with a homomixer at 4000 rpm in a cylindrical flask, 1.0 parts of polyaluminum chloride are added, followed by stirring in this state for 2 hr. It is confirmed by observing with an optical microscope that aggregated particles of 2 μm are generated.

Thereafter, the pH of the system is adjusted to 6.5 with a 0.5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, the volume average particle diameter is confirmed to be 2.4 μm. The GSDv that is an indicator of a particle size distribution is 1.22.

Thereafter, according to a method described in Example 1, magnetic polymer particles (magnetic toner) having a volume average particle diameter of 2.4 μm are obtained.

Furthermore, a liquid developer is prepared and evaluated according to a method described in Example 1.

Example 6

-Production of Magnetic Polymer Particles/Cyan Color-

| | |
|---|---|
| Resin dispersion liquid 1 | 120 parts |
| Colorant dispersion liquid B1 | 15 parts |
| YIG dispersion liquid 1 | 11 parts |

In addition to the foregoing components, 180 parts of ion exchanged water and 1N nitric acid are added to adjust the pH of a dispersion liquid to 2.5. While heating at 45° C. under stirring with a homomixer at 4000 rpm in a cylindrical flask, 1.0 parts of polyaluminum chloride is added, followed by stirring in this state for 2 hr. It is confirmed by observing with an optical microscope that aggregated particles of 2 μm are generated.

Thereafter, the pH of the system is controlled to 6.5 with a 0 5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, the volume average particle diameter is confirmed to be 2.4 μm. The GSDv that is an indicator of a particle size distribution is 1.21

Thereafter according to a method described in Example 1, magnetic polymer particles (magnetic toner) having a volume average particle diameter of 2.4 μm are obtained.

Furthermore, a liquid developer is prepared and evaluated according to a method described in Example 1.

Comparative Example 1

-Preparation of Magnetite Dispersion Liquid 1-

According to a method shown below, a dispersion liquid 1 of magnetite (trade name: MTS010, manufactured by Toda Kogyo Corp.) is prepared.

In the beginning, 400 parts of magnetite (volume average particle diameter: 0.13 μm) are dispersed in a dispersion medium obtained by adding 4 parts of anionic surfactant (trade name: DEMOL EP, manufactured by Kao Corporation) in 400 parts of pure water, followed by pulverizing for 45 min by use of a beads mill (trade name: LMZ06, manufactured by Asizawa Finetech Ltd.) with beads having a diameter of 0.3 mm. Magnetite particles taken out from the beads mill are subjected to decantation and centrifugal separation to remove microparticles and coarse particles, and thereby a magnetite dispersion liquid 1 having a solid concentration of 10% is obtained.

-Production of Magnetic Polymer Particles/Yellow Color-

| | |
|---|---|
| Resin dispersion liquid 1 | 120 parts |
| Colorant dispersion liquid Y1 | 12 parts |
| Magnetite dispersion liquid 1 | 9 parts |

In addition to the foregoing components, 180 parts of ion exchanged water and 1N nitric acid are added to adjust the pH of a dispersion liquid to 2.5. While heating at 45° C. under stirring with a homomixer at 4000 rpm in a cylindrical flask, 1.0 parts of polyaluminum chloride is added, followed by stirring in this state for 2 hr. It is confirmed by observing with an optical microscope that aggregated particles of 2 μm are generated.

Thereafter, the pH of the system is controlled to 6.5 with a 0.5 N aqueous solution of sodium hydroxide, followed by hermetically sealing the cylindrical flask, further followed by heating quickly to 96° C. while continuing stirring at 1500 rpm, followed by keeping it for 3 hr. After cooling, when Coulter Multisizer II is used to measure a volume average particle diameter in a manner similar to the above-mentioned method, a volume average particle diameter is confirmed to be 2.2 μm. The GSDv that is an indicator of a particle size distribution is 1.24.

Furthermore, a liquid developer is prepared and evaluated according to a method described in Example 1.

Example 7

Magnetic polymer particles (magnetic toner) are prepared in a manner substantially similar to a method described in Example 1 except that a composition of "Production of Magnetic Polymer Particles/Yellow Color" in Example 1 is changed as shown below so that content of magnetic material may be a numerical value shown in Table 1 and 2. A volume average particle diameter is measured according to the foregoing method by use of Coulter Multisizer II and confirmed to be 2.2 μm. GSDv that is an indicator of a particle size distribution is 1.22.

Furthermore, a liquid developer is prepared and evaluated in a manner substantially similar to a method described in Example 1.

-Production of Magnetic Polymer Particles/Yellow Color-

| | |
|---|---|
| Resin dispersion liquid 1 | 120 parts |
| Colorant dispersion liquid Y1 | 14 parts |
| YIG dispersion liquid 1 | 17 parts |

Comparative Example 2

Magnetic polymer particles (magnetic toner) are prepared in a manner substantially similar to a method described in Example 1 except that in "Production of Magnetic Polymer Particles/Yellow Color" in Example 1 a neutralization treatment is not applied, specifically an operation in which 2 parts of a 1N aqueous solution of NaOH is added to 100 parts of the resulted particle dispersion liquid, followed by stirring for 24 hour is not applied. When a volume average particle diameter is measured by use of Coulter Multisizer II according to a method described above, it is confirmed to be 2.2 μm. GSDv that is an indicator of a particle size distribution is 1.23.

Furthermore, a liquid developer is prepared and evaluated in a manner substantially similar to a method described in Example 1.

Example 8

A composition of "Production of Magnetic Polymer Particles/Yellow Color" in Example 1 is changed as shown below so that a content of magnetic material may be a numerical value shown in Table 1 and 2.

Magnetic polymer particles (magnetic toner) are prepared in a manner substantially similar to a method described in Example 1 except that a rotation number of a homomixer is changed from 4000 rpm to 2000 rpm in "Production of Magnetic Polymer Particles/Yellow Color" in Example 1 so that a volume average particle diameter of the magnetic polymer particles (magnetic toner) may be 5.0 μm. When a volume average particle diameter is measured by use of Coulter Multisizer II according to a method described above, it is confirmed to be 5.0 μm. GSDv that is an indicator of a particle size distribution is 1.22.

Furthermore, a liquid developer is prepared and evaluated in a manner substantially similar to a method described in Example 1.

-Production of Magnetic Polymer Particles/Yellow Color-

| | |
|---|---|
| Resin dispersion liquid 1 | 120 parts |
| Colorant dispersion liquid Y1 | 14 parts |
| YIG dispersion liquid 1 | 15 parts |

Example 9

A composition of "Production of Magnetic Polymer Particles/Yellow Color" in Example 3 is changed as shown below so that content of magnetic material may be a numerical value shown in Table 1 and 2.

Magnetic polymer particles (magnetic toner) are prepared in a manner substantially similar to a method described in Example 3 except that a rotation number of a homomixer is changed from 4000 rpm to 1800 rpm in "Production of Magnetic Polymer Particles/Magenta Color" in Example 3 so that a volume average particle diameter of the magnetic polymer particles (magnetic toner) may be 5.2 μm. When a volume average particle diameter is measured by use of Coulter Multisizer II according to a method described above, it is confirmed to be 5.2 μm. GSDv that is an indicator of a particle size distribution is 1.23.

Furthermore, a liquid developer is prepared and evaluated in a manner substantially similar to a method described in Example 1.

-Production of Magnetic Polymer Particles/Magenta Color-

| | |
|---|---|
| Resin dispersion liquid 1 | 120 parts |
| Colorant dispersion liquid M1 | 20 parts |
| YIG dispersion liquid 1 | 11 parts |

Example 10

A composition of "Production of Magnetic Polymer Particles/Red Color" in Example 4 is changed as shown below so that content of magnetic material may be a numerical value shown in Table 1 and 2.

Magnetic polymer particles (magnetic toner) are prepared in a manner substantially similar to a method described in Example 4 except that a rotation number of a homomixer is changed from 4000 rpm to 2000 rpm in "Production of Magnetic Polymer Particles/Red Color" in Example 4 so that a volume average particle diameter of the magnetic polymer particles (magnetic toner) may be 5.0 μm. When a volume average particle diameter is measured by use of Coulter Multisizer II according to a method described above, it is confirmed to be 5.0 μm. GSDv that is an indicator of a particle size distribution is 1.22.

Furthermore, a liquid developer is prepared and evaluated in a manner substantially similar to a method described in Example 1.

-Production of Magnetic Polymer Particles/Red Color-

| | |
|---|---|
| Resin dispersion liquid 1 | 120 parts |
| Colorant dispersion liquid M1 | 11 parts |
| Colorant dispersion liquid Y1 | 7 parts |
| YIG dispersion liquid 1 | 14 parts |

Example 11

A composition of "Production of Magnetic Polymer Particles/Green Color" in Example 5 is changed as shown below so that a content of magnetic material may be a numerical value shown in Table 1 and 2.

Magnetic polymer particles (magnetic toner) are prepared in a manner substantially similar to a method described in Example 5 except that a rotation number of a homomixer is changed from 4000 rpm to 1800 rpm in "Production of Magnetic Polymer Particles/Green Color" in Example 5 so that a volume average particle diameter of the magnetic polymer particles (magnetic toner) may be 5.2 μm. When a volume average particle diameter is measured by use of Coulter Multisizer II according to a method described above, it is confirmed to be 5.2 μm. GSDv that is an indicator of a particle size distribution is 1.23.

Furthermore, a liquid developer is prepared and evaluated in a manner substantially similar to a method described in Example 1.

-Production of Magnetic Polymer Particles/Green Color-

| | |
|---|---|
| Resin dispersion liquid 1 | 120 parts |
| Colorant dispersion liquid Y1 | 7 parts |
| Colorant dispersion liquid B1 | 11 parts |
| YIG dispersion liquid 1 | 12 parts |

Example 12

Magnetic polymer particles (magnetic toner) are prepared in a manner substantially similar to a method described in Example 3 except that a rotation number of a homomixer is changed from 4000 rpm to 3500 rpm in "Production of Magnetic Polymer Particles/Magenta Color" in Example 3 so that a volume average particle diameter of the magnetic polymer particles (magnetic toner) may be 3.3 μm. When a volume average particle diameter is measured by use of Coulter Multisizer II according to a method described above, it is confirmed to be 3.3 μm. GSDv that is an indicator of a particle size distribution is 1.26.

Furthermore, a liquid developer is prepared and evaluated in a manner substantially similar to a method described in Example 1.

Example 13

Magnetic polymer particles (magnetic toner) prepared in Example 3 are pulverized by use of a beads mill (trade name: DMS-L65, manufactured by Asizawa Finetech Ltd.), and thereby magnetic polymer particles (magnetic toner) having a volume average particle diameter of 0.9 μm are prepared. GSDv is 1.42.

Furthermore, a liquid developer is prepared and evaluated in a manner substantially similar to a method described in Example 1.

Example 14

Magnetic polymer particles (magnetic toner) are prepared in a manner substantially similar to a method described in Example 3 except that the YIG dispersion liquid 1 is changed from 14 parts to 3 parts in "Production of Magnetic Polymer Particles/Magenta Color" in Example 3. When a volume average particle diameter is measured by use of Coulter Multisizer II according to a method described above, it is confirmed to be 2.3 μm. GSDv that is an indicator of a particle size distribution is 1.24.

Furthermore, a liquid developer is prepared and evaluated in a manner substantially similar to a method described in Example 1.

(Example 15) to (Example 22)

Magnetic polymer particles (magnetic toner) of Example 15 and Example 19 are prepared in a manner substantially similar to a method described in Example 2 except that an amount of colorant dispersion liquid in "Production of Magnetic Polymer Particles" in Example 2 is changed so that content of colorant may be a numerical value shown in Table 1 and 2.

Magnetic polymer particles (magnetic toner) of Example 16 and Example 20 are prepared in a manner substantially similar to a method described in Example 3 except that an amount of colorant dispersion liquid in "Production of Magnetic Polymer Particles" in Example 3 is changed so that content of colorant may be a numerical value shown in Table 1 and 2.

Magnetic polymer particles (magnetic toner) of Example 17 and Example 21 are prepared in a manner substantially similar to a method described in Example 4 except that an amount of colorant dispersion liquid in "Production of Magnetic Polymer Particles" in Example 4 is changed so that content of colorant may be a numerical value shown in Table 1 and 2.

Magnetic polymer particles (magnetic toner) of Example 18 and Example 22 are prepared in a manner substantially similar to a method described in Example 5 except that an amount of colorant dispersion liquid in "Production of Magnetic Polymer Particles" in Example 5 is changed so that content of colorant may be a numerical value shown in Table 1 and 2.

Furthermore, a liquid developer is prepared and evaluated in a manner substantially similar to a method described in Example 1.

TABLE 1

| | Pigment color | Concentration of pigment (%) | Magnetic polymer Particle diameter (μm) | Magnetic material Species | Magnetic material Particle diameter (μm) | Magnetic material Content (%) | Neutralization | Evaluation Fog | Evaluation Color evaluation |
|---|---|---|---|---|---|---|---|---|---|
| Example 1 | Yellow | 9.6 | 2.2 | YIG | 0.4 | 4.8 | Yes | Good | Good ΔE = 2.5 |
| Example 2 | Yellow | 11.5 | 2.3 | YIG | 0.4 | 5.6 | Yes | Good | Good ΔE = 2.5 |
| Example 3 | Magenta | 17.0 | 2.3 | YIG | 0.4 | 4.2 | Yes | Good | Good ΔE = 3 |
| Example 4 | Red | 14.8 | 2.1 | YIG | 0.4 | 4.6 | Yes | Good | Good ΔE = 3.5 |
| Example 5 | Green | 13.1 | 2.4 | YIG | 0.4 | 5.7 | Yes | Good | Good ΔE = 3.5 |
| Example 6 | Cyan | 13.2 | 2.4 | YIG | 0.4 | 4.2 | Yes | Good | Good ΔE = 6.5 |
| Comparative Example 1 | Yellow | 10.0 | 2.2 | Magnetite | 0.2 | 3.8 | Yes | Good | Blackish (Bad) ΔE = 14 |
| Example 7 | Yellow | 11.6 | 2.2 | YIG | 0.4 | 6.8 | Yes | Good | Dull ΔE = 8 |
| Comparative Example 2 | Yellow | 9.7 | 2.2 | YIG | 0.4 | 4.8 | No | Bad | Good ΔE = 2.5 |
| Example 8 | Yellow | 12.0 | 5.0 | YIG | 0.4 | 5.4 | Yes | Good | Dull ΔE = 10 |
| Example 9 | Magenta | 16.8 | 5.2 | YIG | 0.4 | 4.2 | Yes | Good | Dull ΔE = 12 |
| Example 10 | Red | 15.0 | 5.0 | YIG | 0.4 | 5.4 | Yes | Good | Dull ΔE = 15 |
| Example 11 | Green | 15.4 | 5.2 | YIG | 0.4 | 4.2 | Yes | Good | Dull ΔE = 15 |

TABLE 2

| | Pigment color | Concentration of pigment (%) | Magnetic polymer Particle diameter (μm) | Magnetic material Species | Magnetic material Particle diameter (μm) | Magnetic material Content (%) | Neutralization | Evaluation Fog | Evaluation Color evaluation |
|---|---|---|---|---|---|---|---|---|---|
| Example 12 | Magenta | 16.9 | 3.3 | YIG | 0.4 | 4.2 | Yes | Good | Dull ΔE = 9 |
| Example 13 | Magenta | 17.0 | 0.9 | YIG | 0.4 | 4.0 | Yes | Good | Dull ΔE = 8 |
| Example 14 | Magenta | 17.9 | 2.3 | YIG | 0.4 | 0.9 | Yes | Good | Dull ΔE = 10 |
| Example 15 | Yellow | 8.5 | 2.3 | YIG | 0.4 | 5.6 | Yes | Good | Good ΔE = 2.5 |
| Example 16 | Magenta | 14.2 | 2.3 | YIG | 0.4 | 4.2 | Yes | Good | Good ΔE = 2.5 |
| Example 17 | Red | 11.8 | 2.1 | YIG | 0.4 | 4.6 | Yes | Good | Good ΔE = 3 |
| Example 18 | Green | 9.5 | 2.4 | YIG | 0.4 | 5.7 | Yes | Good | Good ΔE = 3.5 |
| Example 19 | Yellow | 7.0 | 2.3 | YIG | 0.4 | 5.6 | Yes | Good | Good ΔE = 5.5 |
| Example 20 | Magenta | 13.2 | 2.3 | YIG | 0.4 | 4.2 | Yes | Good | Good ΔE = 6.2 |
| Example 21 | Red | 10.0 | 2.1 | YIG | 0.4 | 4.6 | Yes | Good | Good ΔE = 6.6 |
| Example 22 | Green | 8.0 | 2.4 | YIG | 0.4 | 5.7 | Yes | Good | Good ΔE = 5.8 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

magnetic polymer particles including a magnetic material containing yttrium iron garnet (YIG), a polymer compound having a carboxylate salt structure, and a colorant; and a dispersion medium in which the magnetic polymer particles are dispersed.

2. The liquid developer of claim 1, wherein a number average particle diameter of the magnetic material is about 0.2 μm or more but about 1.8 μm or less.

3. The liquid developer of claim 1, wherein a magnetization of the magnetic material in a magnetic field of 500 Oe is about 10 emu/g or more.

4. The liquid developer of claim 1, wherein a surface of the magnetic material is hydrophobicized.

5. The liquid developer of claim 1, wherein the hydrophobicization is a surface coating treatment with a coupling agent.

6. The liquid developer of claim 1, wherein the polymer compound is a thermoplastic resin.

7. The liquid developer of claim 1, wherein the polymer compound has at least one selected from a hydroxyl group or an alkyl ester group thereof.

8. The liquid developer of claim 1, wherein an amount of carboxyl groups in the polymer compound is about 0.005 mmol/g or more but about 0.5 mmol/g or less.

9. The liquid developer of claim 1, wherein an amount of hydroxyl groups in the polymer compound is about 0.2 mmol/g or more but about 4.0 mmol/g or less.

10. The liquid developer of claim 1, wherein a volume average particle diameter of the magnetic polymer particles is about 1 μm or more but about 3 μm or less.

11. The liquid developer of claim 1, wherein GSDv of the magnetic polymer particles, which is an indicator of a particle size distribution, is about 1.30 or less.

12. The liquid developer of claim 1, comprising the magnetic polymer particles in an amount of about 0.5% by weight or more but about 40% by weight or less.

13. The liquid developer of claim 1, wherein a content of the magnetic material in the magnetic polymer particles is in the range of about 1% by weight or more but about 6% by weight or less.

14. The liquid developer of claim 1, which forms a yellow, magenta, red or green color.

15. The liquid developer of claim 14, which forms a yellow color, wherein a content of the colorant in the magnetic polymer particles is about 8% by weight or more but about 40% by weight or less.

16. The liquid developer of claim 14, which forms a magenta color, wherein a content of the colorant in the magnetic polymer particles is about 14% by weight or more but about 40% by weight or less.

17. The liquid developer of claim 14, which forms a red color, wherein a content of the colorant in the magnetic polymer particles is about 11% by weight or more but about 40% by weight or less.

18. The liquid developer of claim 14, which forms a green color, wherein a content of the colorant in the magnetic polymer particles is about 9% by weight or more but about 40% by weight or less.

19. A method for producing a liquid developer, comprising:

aggregating a magnetic material containing yttrium iron garnet (YIG), a polymer compound having a carboxyl group, and a colorant in an emulsified liquid to form aggregated particles;

neutralizing the aggregated particles to obtain magnetic polymer particles; and dispersing the magnetic polymer particles in a dispersion medium.

20. An image forming apparatus comprising:

a magnetic latent image holding member;

a magnetic latent image forming unit that forms a magnetic latent image on the magnetic latent image holding member;

a developer storage unit that stores the liquid developer of claim 1;

a developer feeding unit that feeds the developer to the magnetic latent image holding member on which the magnetic latent image has been formed to visualize the magnetic latent image as a developed image;

a transfer unit that transfers the developed image to a recording medium; and a degaussing unit that degausses the magnetic latent image on the magnetic latent image holding member.

* * * * *